US007008040B2

(12) United States Patent
Nakajima

(10) Patent No.: US 7,008,040 B2
(45) Date of Patent: Mar. 7, 2006

(54) INK JET PRINTER AND IMAGE PRINTING SYSTEM AS WELL AS PRINTING METHODS THEREFOR

(75) Inventor: Kenichi Nakajima, Shimosuwa-Machi (JP)

(73) Assignee: Seiko Epson Corporation, Tokyo (JP)

( * ) Notice: Subject to any disclaimer, the term of this patent is extended or adjusted under 35 U.S.C. 154(b) by 981 days.

(21) Appl. No.: 10/053,484

(22) Filed: Jan. 17, 2002

(65) Prior Publication Data

US 2002/0113981 A1 Aug. 22, 2002

(30) Foreign Application Priority Data

Feb. 1, 2001 (JP) ..... 2001-025619
Feb. 22, 2001 (JP) ..... 2001-047073

(51) Int. Cl.
*B41J 2/15* (2006.01)

(52) U.S. Cl. ..... 347/41; 347/16
(58) Field of Classification Search ..... 347/16, 347/15, 41, 40, 12, 37
See application file for complete search history.

(56) References Cited

U.S. PATENT DOCUMENTS

| | | | | |
|---|---|---|---|---|
| 4,739,415 | A | 4/1988 | Toyono et al. | |
| 5,993,087 | A | 11/1999 | Katada et al. | |
| 6,652,066 | B1 * | 11/2003 | Teshigawara et al. | 347/41 |
| 6,695,432 | B1 * | 2/2004 | Kanda | 347/41 |
| 6,779,873 | B1 * | 8/2004 | Maeda et al. | 347/43 |

FOREIGN PATENT DOCUMENTS

| | | |
|---|---|---|
| EP | 0 881 820 | 2/1998 |
| JP | 60-232767 | 11/1985 |
| JP | 60-232769 | 11/1985 |
| JP | 60-233979 | 11/1985 |

(Continued)

*Primary Examiner*—Lamson Nguyen
(74) *Attorney, Agent, or Firm*—Hogan & Hartson, L.L.P.

(57) ABSTRACT

There are provided an ink jet printer capable of printing efficiently by reducing the useless operation dependent on the width of a print image to thereby increase the printing speed and an image printing system incorporating the ink jet printer, as well as printing methods therefor. In one aspect, a print head capable of simultaneously printing M dots at a predetermined nozzle pitch in an X-axis direction is scanned in the X-axis and a Y-axis direction, to print an image on a medium. The print image width in the Y-axis direction is detected. Depending on the width, a head moving pitch in the X-axis direction relative scan is determined. The scanning of the head in the X-axis direction relative to the print medium prints maximum M dot lines along the X-axis juxtaposed in the Y-axis direction. The scanning of the head in the Y-axis direction is effected by moving the head relative to the medium at the head moving pitch, after printing by the scanning of the head in the X-axis direction. In another aspect, odd number-time printing is carried out in a predetermined area such that the head starts from a starting point to an end point along a predetermined path. Even number-time printing is carried out in the predetermined area such that the head starts from the end point to the starting point along the path. After each printing, the medium is fed in the X-axis direction by an amount of the unitary print image.

16 Claims, 17 Drawing Sheets

FOREIGN PATENT DOCUMENTS

| | | |
|---|---|---|
| JP | 02-018099 | 1/1990 |
| JP | 06-064175 | 3/1994 |
| JP | 06-171077 | 6/1994 |
| JP | 10-226125 | 8/1998 |
| JP | 10-250120 | 9/1998 |
| JP | 10-329492 | 12/1998 |
| JP | 2000-118058 | 4/2000 |
| JP | 2001-047663 | 2/2001 |

* cited by examiner

| j \ i | 0 | 1 | 2 | 3 |
|---|---|---|---|---|
| 0 | 0 | 3 | 6 | 9 |
| 1 | 4 | 7 | 10 | 13 |
| 2 | 8 | 11 | 14 | 17 |
| 3 | 12 | 15 | 18 | 21 |
| 4 | 16 | 19 | 22 | 25 |
| 5 | 20 | 23 | 26 | 29 |
| 6 | 24 | 27 | 30 | 33 |

| Step \ Pass | 1 | 2 | 3 | 4 |
|---|---|---|---|---|
| t=0 | ① | | | |
| 1 | | | | |
| 2 | | | | |
| 3 | ② | | | |
| 4 | | ① | | |
| 5 | | | | |
| 6 | ③ | | | |
| 7 | | ② | | |
| 8 | | | ① | |
| 9 | ④ | | | |
| 10 | | ③ | | |
| 11 | | | ② | |
| 12 | | | | ① |
| 13 | | ④ | | |
| 14 | | | ③ | |

INK JET PRINTER AND IMAGE PRINTING SYSTEM AS WELL AS PRINTING METHODS THEREFOR

BACKGROUND OF THE INVENTION

1. Field of the Invention

This invention relates to an ink jet printer and an image printing system as well as printing method therefor, and more particularly to an ink jet printer for printing a print image on a print medium by scanning a print head (ink jet head) having a plurality of nozzles arranged in a Y-axis direction, assuming that two axes orthogonal to each other on a two-dimensional rectangular coordinate system are an X axis and the Y axis, in directions along the X axis and the Y axis, relative to the print medium, and an image printing system incorporating the ink jet printer, as well as printing methods therefor.

2. Prior Art

Conventionally, in the ink jet printer of the above-mentioned kind employs a printing method (first printing method) described below, due to the merit of capable of making constant the amount of feed (head moving pitch) in the direction along the Y axis. For example, the present assignee has also proposed an ink jet printer of this kind (Japanese Laid-Open Patent Publication (Kokai) No. 10-250120). In the case of the first printing method, assuming that the head moving pitch and a nozzle pitch are represented by P and D, respectively, a printable dot (position thereof) R can be expressed by $R=P\times j+D\times i$. For example, as shown in FIG. 10A, assuming that the head moving pitch P is 4, and the nozzle pitch D is 3 (and hence the printable dot $R=4j+3i$), and four nozzles designated by circled numbers 1 to 4 in the figure (represented by i=0, 1, 2, 3 in the figure) are used, it is possible to print dots from a sixth dot from a reference position (position to be assumed by a nozzle of encircled number 1 during a first printing pass (Pass=1 in the figure)) in a continuous manner, i.e. without forming a break or unprinted dot between printed dots (see FIG. 10B). This fact is shown in FIG. 10B as OK from Step=6 (which is the number of dots representative of the distance "t" of each nozzle from the reference position).

However, according to this printing method, it is necessary to start printing operation from outside the actual printing area. For example, in the case of the illustrated example shown in FIGS. 10A and 10B, as indicated by "OK from Step=6", the actual printing area is below the line indicated by OK (Step=6) in FIG. 10B. However, the printing operation has to be started after moving the print head to a position which is above, in the figure, than the line of OK, and in which the position assumed by the nozzle designated by encircled number 1 is the reference position t=0. In other words, this printing operation includes a portion which does not contribute to actual printing and hence is useless. Particularly, when the width of a print image in the direction along the Y axis (hereinafter referred to as "the Y-axis direction"), i.e. the width of lower part than the above-mentioned OK in the figure is small, the ratio of a useless portion of the printing operation becomes large relative to an effective portion of the same, so that the overall printing efficiency is degraded, which lowers the printing speed.

On the other hand, an ink jet printer has not been conventionally known which prints a print image on a print medium by scanning a print head (ink jet head) in X-axis and Y-axis directions relative to the print medium, while feeding the print medium in the X-axis direction. For example, an ink jet printer has not been known in which a continuous (tape-shaped) print medium is mounted such that the longitudinal direction thereof coincides with the X axis, and which performs printing by a plurality of nozzles (of the ink jet head) juxtaposed in the Y-axis direction while feeding the print medium in the X-axis direction.

If an attempt is made to print on the print medium, e.g. the tape-shaped one, by feeding the same in the X-axis direction, there arises a problem which cannot occur when the print medium is fed in the Y-axis direction. For example, as shown in FIGS. 16A, 16B, when a print head PH prints a unitary print image D1 by feeding the print medium in the X-axis direction designated by a thick arrow in the figure, the amount of movement (indicated by one dot chain line) for returning the print head to its origin or the home position (starting point) SP is large and it takes time before the print head is brought to this position, necessarily causing the lowered printing speed. Particularly, when the width of the print image in the Y-axis direction is large, the time for returning the print head to the home position tends to become large relative to the time required in feeding the print medium, so that the overall printing efficiency is degraded, which lowers the printing speed.

SUMMARY OF THE INVENTION

It is an object of the present invention to provide an ink jet printer which is capable of printing efficiently by reducing the useless operation in dependence on the width of a print image to thereby increase the printing speed and an image printing system incorporating the ink jet printer, as well as printing methods therefor.

To attain the above object, according to a first aspect of the invention, there is provided an ink jet printer including a print head having M nozzles, where M is an integer equal to or larger than 2, the print head capable of simultaneously printing M dots at a predetermined nozzle pitch in a direction along a Y axis, assuming that two axes orthogonal to each other on a two-dimensional rectangular coordinate system are set to an X axis and the Y axis, respectively, the ink jet printer printing a print image on a print medium while feeding the print medium in a direction along the X axis, by causing relative scan of the print head in the direction along the X axis and in the direction along the Y axis, relative to the print medium.

The ink jet printer according to the first aspect of the invention is characterized by comprising:

print image width-determining means for determining a print image width defined as a width of the print image in the direction along the Y axis;

head moving pitch-setting means for setting a head moving pitch in the relative scan in the direction along the Y axis, based on the print image width;

X-axis relative scan means for causing the relative scan of the print head in the direction along the X axis relative to the print medium, thereby causing printing of maximum M dot lines extending in the direction along the X axis arranged side by side in the Y-axis direction; and Y-axis relative scan means for causing the relative scan of the print head in the direction along the Y axis, by moving the print head relative to the print medium at the head moving pitch, after printing by the relative scan of the print head in the direction along the X axis.

To attain the above object, according to a second aspect of the invention, there is provided a printing method for an ink jet printer including a print head having M nozzles, where M is an integer equal to or larger than 2, the print head capable of simultaneously printing M dots at a predetermined nozzle pitch in a direction along a Y axis, assuming that two axes orthogonal to each other on a two-dimensional rectangular coordinate system are set to an X axis and the Y axis, respectively, the ink jet printer printing a print image on a print medium while feeding the print medium in a direction along the X axis, by causing relative scan of the print head in the direction along the X axis and in the direction along the Y axis, relative to the print medium.

The printing method according to the second aspect of the invention is characterized by comprising the steps of:

determining a print image width defined as a width of the print image in the direction along the Y axis;

setting a head moving pitch in the relative scan in the direction along the Y axis, based on the print image width;

causing the relative scan of the print head in the direction along the X axis relative to the print medium, thereby printing maximum M dot lines extending in the direction along the X axis arranged side by side in the Y-axis direction; and causing the relative scan of the print head in the direction along the Y axis, by moving the print head relative to the print medium at the head moving pitch, after printing by the relative scan of the print head in the direction along the X axis.

According to this ink jet printer and printing method therefor, a print image is printed on a print medium by causing relative scan of the print head that has M nozzles and is capable of simultaneously printing M dots at a predetermined nozzle pitch in the direction along the X axis. In doing this, the print image width as the width of the print image in the direction along the Y axis (hereinafter, also referred to as "the Y-axis direction") is determined, and based on the print image width, the head moving pitch in the relative scan in the Y-axis direction is set. This makes the head moving pitch appropriate for the print image width. Further, since the print head is moved relative to the print medium at the appropriate head moving pitch, it is possible to reduce useless relative scan in the Y-axis direction, i.e. the amount of useless printing operation. Thus, the useless printing operation can be reduced in dependence on the width of the print image, whereby efficient printing can be attained and the printing speed can be increased.

Preferably, the head moving pitch-setting means includes head moving pitch-determining means for determining the head moving pitch in the direction along the Y axis according to the print image width.

Preferably, the step of setting a head moving pitch includes determining the head moving pitch according to the print image width.

According to these preferred embodiments, the head moving pitch-setting means includes head moving pitch-determining means for determining the head moving pitch according to the print image width. Therefore, it is possible to determine the optimum head moving pitch with ease.

More preferably, the head moving pitch-determining means determines the head moving pitch by looking up tables of printing dot numbers corresponding to respective combinations of each of consecutive integers representative of respective ones of the M nozzles and each of integers representative of respective positions in order of printing passes in a sequence of the printing passes, the tables being prepared for respective values of the head moving pitch.

More preferably, the head moving pitch is determined by looking up tables of printing dot numbers corresponding to respective combinations of each of consecutive integers representative of respective ones of the M nozzles and each of integers representative of respective positions of printing passes in a sequence of the printing passes, the tables being prepared for respective values of the head moving pitch.

Preferably, the head moving pitch-setting means includes print width-comparing means for comparing a unitary printable width determined based on a nozzle array length corresponding to a distance between ones of the M nozzles of the print head at respective opposite ends of an array of the nozzles, and the print image width.

Preferably, the step of setting a head moving pitch includes comparing a unitary printable width determined based on a nozzle array length corresponding to a distance between ones of the M nozzles of the print head at respective opposite ends of an array of the nozzles, and the print image width.

According to these preferred embodiments, comparison is carried out between a unitary printable width determined based on a nozzle array length corresponding to a distance between ones of the M nozzles of the print head at respective opposite ends of an array of the nozzles, and the print image width. Therefore, with reference to (based on) the result of the comparison, the head moving pitch can be set. For instance, it is possible to easily employ different head moving pitches between the case of the single printable width is equal to or larger than the print image width and the case of the single printable width being smaller than the print image width. This makes it possible to reduce the useless printing operation according to the width of a print image, and thereby attain the increased printing speed.

Preferably, the head moving pitch-setting means includes print resolution-dependent adjusting means for adjusting the head moving pitch based on relationship between the nozzle pitch of the print head and a resolution of the print image.

Preferably, the step of setting a head moving pitch includes adjusting the head moving pitch based on relationship between the nozzle pitch of the print head and a resolution of the print image.

According to these preferred embodiments, the head moving pitch is adjusted based on relationship between the nozzle pitch of the print head and a resolution of the print image. Therefore, it is possible to set the head moving pitch by taking into account not only the width of a print image but also the resolution thereof. This makes it possible to reduce the useless printing operation according to the width of a print image and the resolution thereof, and thereby attain the increased printing speed.

Preferably, the ink jet printer further includes print image storage means for storing print image data representing the print image.

Preferably, the printing method further includes the step of storing print image data representing the print image.

According to these preferred embodiments, the print image data representing the print image is stored, and therefore, the print image width can be determined with reference to the print image data.

Preferably, the ink jet printer further includes print medium width-detecting means for detecting a width of the print medium in the direction along the Y axis as a print medium width.

Preferably, the printing method further includes the step of detecting a width of the print medium in the direction along the Y axis as a print medium width.

According to these preferred embodiments, the width of the print medium in the direction along the Y axis is detected as the print medium width. Therefore, the print image width can be determined more easily, e.g. by setting the detected print medium width to default print image width (maximum printable width).

Preferably, in the ink jet printer, the print medium is a continuous one, and is mounted in the ink jet printer such that a direction along a length thereof coincides with the direction along the X axis.

Preferably, in the printing method, the print medium is a continuous one, and is mounted in the ink jet printer such that a direction along a length thereof coincides with the direction along the X axis.

According to these preferred embodiments, the print medium is a continuous one, and is mounted such that the direction along the length thereof coincides with the direction along the X axis. Therefore, it is possible to increase the amount of print which can be effected per scan, and thereby further increase the printing speed.

To attain the above object, according to a third aspect of the invention, there is provided an ink jet printer including a print head having a plurality of nozzles arranged side by side in a direction along a Y axis, assuming that two axes orthogonal to each other on a two-dimensional rectangular coordinate system are set to an X axis and the Y axis, respectively, the ink jet printer printing a unitary print image a plurality of times on a print medium while feeding the print medium in a direction along the X axis, by causing relative scan of the print head in the direction along the X axis and in the direction along the Y axis, relative to the print medium.

The ink jet printer according to the third aspect of the invention is characterized by comprising:

odd number-time printing operation means for performing each odd number-time printing operation out of the plurality of printing operations, by causing the relative scan of the print head relative to the print medium in a predetermined print area in which the relative scan of the print head is to be effected for printing the unitary print image, such that the print head starts from a starting point of a predetermined scanning path and reaches an end point of the predetermined scanning path;

even number-time printing operation means for performing even number-time printing operation out of the plurality of printing operations, by causing the relative scan of the print head relative to the print medium in the predetermined print area such that the print head starts from the end point of the predetermined scanning path and reaches the starting point of the predetermined scanning path; and print medium-feeding means for feeding the print medium in the direction along the X axis by an amount of the unitary print image after the odd number-time printing operation or the even number-time printing operation.

To attain the above object, according to a fourth aspect of the invention, there is provided a printing method for an ink jet printer including a print head having a plurality of nozzles arranged side by side in a direction along a Y axis, assuming that two axes orthogonal to each other on a two-dimensional rectangular coordinate system are set to an X axis and the Y axis, respectively, the ink jet printer printing a unitary print image a plurality of times on a print medium while feeding the print medium in a direction along the X axis, by causing relative scan of the print head in the direction along the X axis and in the direction along the Y axis, relative to the print medium.

The printing method comprising the steps of:

performing each odd number-time printing operation out of the plurality of printing operations, by causing the relative scan of the print head relative to the print medium in a predetermined print area in which the relative scan of the print head is to be effected for printing the unitary print image, such that the print head starts from a starting point of a predetermined scanning path and reaches an end point of the predetermined scanning path;

performing even number-time printing operation out of the plurality of printing operations, by causing the relative scan of the print head relative to the print medium in the predetermined print area such that the print head starts from the end point of the predetermined scanning path and reaches the starting point of the predetermined scanning path; and feeding the print medium in the direction along the X axis by an amount of the unitary print image after the odd number-time printing operation or the even number-time printing operation.

According to the ink jet printer and the printing method therefore, while feeding a print medium in the X-axis direction, a print head having a plurality of nozzles arranged side by side in the Y-axis direction is scanned relative to the print medium in the X-axis direction and the Y-axis direction, to print a unitary print image a plurality of times on the print medium. In doing this, each odd number-time printing operation out of the plurality of printing operations is performed by causing the relative scan of the print head relative to the print medium in a predetermined print area in which the relative scan of the print head is to be effected for printing the unitary print image, such that the print head starts from a starting point of a predetermined scanning path and reaches an end point of the predetermined scanning path, and even number-time printing operation out of the plurality of printing operations is performed by causing relative scan of the print head relative to the print medium in the predetermined print area such that the print head starts from the end point of the predetermined scanning path and reaches the starting point of the predetermined scanning path. In short, in the odd number-time and even number-time printing operations, the same scanning path (scanning route) is followed in respective directions opposite to each other. This makes it unnecessary to perform motion of the print head to return to the home position after each odd number-time or even number-time printing operation, within a time period for feeding the print medium in the X-axis direction by an amount of the unitary print image. Therefore, when an unitary print image is printed on the print medium a plurality of times by scanning the print head having a plurality of nozzles arranged side by side in the Y-axis direction in the X-axis direction and the Y-axis direction relative to the print medium, the useless printing operation or time required therefor can be minimized to increase the printing speed.

Preferably, in the ink jet printer, the print medium is in a continuous form, and is mounted in the ink jet printer such that a direction along a length of the print medium coincides with the direction along the X axis.

Preferably, in the printing method, the print medium is in a continuous form, and is mounted in the ink jet printer such that a direction along a length of the print medium coincides with the direction along the X axis.

According to these preferred embodiments, the print medium is a continuous one, and is mounted such that the direction along the length thereof coincides with the direction along the X axis. Therefore, it is possible to increase the amount of print which can be effected per scan, and thereby further increase the printing speed.

More preferably, in the ink jet printer, the unitary print image is formed by arranging N copies, where N is an integer, of a print image represented by a print image data prepared in advance, side by side in the direction along the X axis with respect to the print medium.

More preferably, in the printing method, the unitary print image is formed by arranging N copies, where N is an integer, of a print image represented by a print image data prepared in advance, side by side in the direction along the X axis with respect to the print medium.

According to these preferred embodiments, the unitary print image is formed by arranging N copies of a print image represented by a print image data prepared in advance, side by side in the direction along the X axis with respect to the print medium. That is, the unitary print image having N copies of the original print image arranged side by side can be printed per printing operation, and this unit of image can be printed plurality of times. This makes it possible to print a large number copies of the original print image at a high speed.

Further preferably, the print image is formed by a matrix of J dots in the direction along the X axis by K dots in the direction along the Y axis, where J is an integer equal to or larger than 2 and K is an integer equal to or larger than 2, and the ink jet printer further comprises line data-receiving means for sequentially receiving line data items of the print egg image data, each representing one line of the J dots arranged in the direction along the X axis, in parallel with or prior to a first one of the plurality of printing operations, according to a predetermined communication protocol from a predetermined other end of communication, thereby sequentially receiving K line data items corresponding to K lines in the direction along the Y axis, and long line data-forming means for setting a k-th line data item (k is an arbitrary integer defined as $1 \leqq k \leqq K$) of the K line data items to a k-th short line data item when the k-th line data item is received, and sequentially arranging N copies of the k-th short line data item side by side to form a k-th long line data item representing one line of J×N dots formed by arranging N lines of the J dots in the direction along the X axis, wherein in the odd number-time printing operation or the even number-time printing operation, printing is performed such that the one line of J×N dots represented by the k-th long line data item is printed as a k-th line on the print medium in the direction along the X axis thereof.

Further preferably, the print image is formed by a matrix of J dots in the direction along the X axis by K dots in the direction along the Y axis, where J is an integer equal to or larger than 2 and K is an integer equal to or larger than 2, and the printing method further comprises the steps of sequentially receiving line data items of the print image data, each representing one line of the J dots arranged in the direction along the X axis, in parallel with or prior to a first one of the plurality of printing operations, according to a predetermined communication protocol from a predetermined other end of communication, thereby sequentially receiving K line data items corresponding to K lines in the direction along the Y axis, and setting a k-th line data item (k is an arbitrary integer defined as $1 \leqq k \leqq K$) of the K line data items to a k-th short line data item when the k-th line data item is received, and sequentially arranging N copies of the k-th short line data item side by side to form a k-th long line data item representing one line of J×N dots formed by arranging N lines of the J dots in the direction along the X axis, wherein in the odd number-time printing operation or the even number-time printing operation, printing is performed such that the one line of J×N dots represented by the k-th long line data item is printed as a k-th line on the print medium in the direction along the X axis thereof.

According to these preferred embodiments, the print image is formed by a matrix of J dots in the direction along the X axis by K dots in the direction along the Y axis, where J is an integer equal to or larger than 2 and K is an integer equal to or larger than 2, and line data items of the print image data, each representing one line of the J dots arranged in the direction along the X axis, are sequentially received in parallel with or prior to a first one of the plurality of printing operations, according to a predetermined communication protocol from a predetermined other end of communication, thereby sequentially receiving K line data items corresponding to K lines in the direction along the Y axis. Further, a k-th line data item (k is an arbitrary integer defined as $1 \leqq k \leqq K$) of the K line data items is set to a k-th short line data item when the k-th line data item is received, and N copies of the k-th short line data item are sequentially arranged side by side to form a k-th long line data item representing one line of J×N dots formed by arranging N lines of the J dots in the direction along the X axis. Then, the one line of J×N dots represented by the k-th long line data item is printed as a k-th line on the print medium in the direction along the X axis thereof.

In this case, after receiving K-th line data (k-th short line data), k-th long line data can be formed by arranging N copies thereof. That is, it is not necessary to wait for reception of the whole K line data (i.e. whole print image data), but it is possible to print one line formed by N times J dots whenever each line data representing a line of J dots is received. This makes it possible to perform parallel processing of communication or reception of print image data and printing of a unitary print image to be effected thereafter for at least a first printing operation, and the printing speed can be further increased as a whole.

To attain the above object, according to a fifth aspect of the invention, there is provided an image printing system comprising:

an ink jet printer including a print head a plurality of nozzles arranged side by side in a direction along a Y axis, assuming that two axes orthogonal to each other on a two-dimensional rectangular coordinate system are set to an X axis and the Y axis, respectively, the ink jet printer printing a unitary print image a plurality of times on a print medium which is in a continuous form and is mounted in the ink jet printer such that a direction along a length of the print medium coincides with a direction along the X axis, while feeding the print medium in the direction along the X axis, by causing relative scan of the print head in the direction along the X axis and in the direction along the Y axis, relative to the print medium, the unitary print image being formed by arranging N copies, where N is an integer, of a print image side by side in the direction along the X axis with respect to the print medium, the print image being represented by a print image data formed by a matrix of J dots in the direction along the X axis by K dots in the direction along the Y axis, where J is an integer equal to or larger than 2 and K is an integer equal to or larger than 2, and prepared in advance, the ink jet printer comprising:

odd number-time printing operation means for performing each odd number-time printing operation out of the plurality of printing operations, by causing the relative scan of the print head relative to the print medium in a predetermined print area in which the relative scan of the print head is to be effected for printing the unitary print image, such that the print head starts from a starting point of a predetermined scanning path and reaches an end point of the predetermined scanning path, even number-time printing operation means for performing even number-time printing operation out of the plurality of printing operations, by causing the relative scan of the print head relative to the print medium in the predetermined print area such that the print head starts from the end point of the predetermined scanning path and reaches the starting point of the predetermined scanning path, print medium-feeding means for feeding the print medium in the direction along the X axis by an amount of the unitary print image after the odd number-time printing operation or the even number-time printing operation, line data-receiving means for sequentially receiving line data items of the print image data, each representing one line of the J dots arranged in the direction along the X axis, in parallel with or prior to a first one of the plurality of printing operations, according to a predetermined communication protocol from a predetermined other end of communication, thereby sequentially receiving K line data items corresponding to K lines in the direction along the Y axis, and long line data-forming means for setting a k-th line data item (k is an arbitrary integer defined as $1 \leqq k \leqq K$) of the K line data items to a k-th short line data item when the k-th line data item is received, and sequentially arranging N copies of the k-th short line data item side by side to form a k-th long line data item representing one line of J×N dots formed by arranging N lines of the J dots in the direction along the X axis, wherein in the odd number-time printing operation or the even number-time printing operation, printing is performed such that the one line of J×N dots represented by the k-th long line data item is printed as a k-th line on the print medium in the direction along the X axis thereof;

print image forming means for forming the print image data;

print image communication means for sequentially sending the K line data out of the formed print image data;, and a first interface for enabling communication between the print image communication means and the line data-receiving means.

To attain the above object, according to a six aspect of the invention, there is provided a printing method for an image printing system incorporating an ink jet printer, comprising the steps of:

forming print image data representing a print image and formed by a matrix of J dots in a direction along an X axis by K dots in a direction along a Y axis, where J is an integer equal to or larger than 2 and K is an integer equal to or larger than 2, assuming that two axes orthogonal to each other on a two-dimensional rectangular coordinate system are set to the axis and the Y axis;

transmitting K line data items of the formed print image data sequentially via a first interface; and printing a unitary print image a plurality of times on a print medium which is in a continuous form and is mounted in the ink jet printer such that a direction along a length of the print medium coincides with the direction along the X axis, while feeding the print medium in the direction along the X axis, by causing relative scan of a print head having a plurality of nozzles arranged side by side in the direction along the Y axis, in the direction along the X axis and in the direction along the Y axis, relative to the print medium, the unitary print image being formed by arranging N copies, where N is an integer, of a print image side by side in the direction along the X axis with respect to the print medium, the step of printing a unitary print image a plurality of times, including:

sequentially receiving line data items of the print image data, each representing one line of the J dots arranged in the direction along the X axis, in parallel with or prior to a first one of the plurality of printing operations, according to a predetermined communication protocol from a predetermined other end of communication, thereby sequentially receiving K line data items corresponding to K lines in the direction along the Y axis, and setting a k-th line data item (k is an arbitrary integer defined as $1 \leqq k \leqq K$) of the K line data items to a k-th short line data item when the k-th line data item is received, and sequentially arranging N copies of the k-th short line data item side by side to form a k-th long line data item representing one line of J×N dots formed by arranging N lines of the J dots in the direction along the X axis, performing each odd number-time printing operation out of the plurality of printing operations, by causing the relative scan of the print head relative to the print medium in a predetermined print area in which the relative scan of the print head is to be effected for printing the unitary print image, such that the print head starts from a starting point of a predetermined scanning path and reaches an end point of the predetermined scanning path, such that the one line of J×N dots represented by the k-th long line data item is printed as a k-th line on the print medium in the direction along the X axis thereof, performing even number-time printing operation out of the plurality of printing operations, by causing the relative scan of the print head relative to the print medium in the predetermined print area such that the print head starts from the end point of the predetermined scanning path and reaches the starting point of the predetermined scanning path, such that the one line of J×N dots represented by the k-th long line data item is printed as the k-th line on the print medium in the direction along the X axis thereof, and feeding the print medium in the direction along the X axis by an amount of the unitary print image, after the odd number-time printing operation or the even number-time printing operation.

According to the image printing system and printing method therefor, print image data is formed, and the K line data items of the formed print image data are sequentially sent via a first interface. On the receiving side when the k-th line data item is received, and N copies of the k-th short line data item are sequentially arranged side by side to form a k-th long line data item representing one line of J×N dots formed by arranging N lines of the J dots in the direction along the X axis, and the one line of J×N dots represented by the k-th long line data item is printed as a k-th line on the print medium in the direction along the X axis thereof. Therefore, it is possible to form a print image data representing a desired print image, send each line data item representing one line of the image, via the first interface, and thereby attain the printing of a unitary print image formed by N copies of the print image a plurality of times at an increased speed.

Preferably, in the image printing system, the first interface enables communication in conformity to an interface standard of RS-232C, USB, or IEEE1394.

Preferably, in the printing method, the first interface enables communication in conformity to an interface standard of RS-232C, USB, or IEEE1394.

According to these preferred embodiments, the first interface enables communication in conformity to the interface standard of RS-232C, USB, or IEEE1394, and hence it is possible to communicate print image data representing a desired print image in units of line data items according to the interface standard of RS-232C, USB, or IEEE1394, and at the same time accelerate printing of a plurality of the print images.

Preferably, in the image printing system, the first interface enables communication in conformity to the Centronics standard.

Preferably, in the printing method, the first interface enables communication in conformity to the Centronics standard.

According to these preferred embodiment, since the first interface enables communication in conformity to the Centronics standard, it is possible to communicate print image data representing a desired print image in units of line data items according to the Centronics standard, and at the same time accelerate printing of a plurality of the print images.

Preferably, the image printing system further includes a second interface enabling transmission of the print image data, and the print image communication means includes image data-transmitting means for transmitting the print image data via the second interface, data dividing means for receiving the print image data via the second interface and dividing the print image data into the K line data items, and line data transmitting means for sequentially transmitting the divided K line data items one by one via the first interface.

Preferably, the step of transmitting K line data includes transmitting the print image data via a second interface, receiving the print image data via the second interface and dividing the print image data into the K line data items, and sequentially transmitting the divided K line data items one by one via the first interface.

According to these preferred embodiments, print image data is formed, and then transmitted via the second interface. On the reception side, the received print image data is divided into K line data items to sequentially send the K line data items one by one via the first interface, and then a k-th long line data item is formed based on the k-th short line data item. One line of J×N dots represented by the produced k-th long line data item is printed as a k-th line on the print medium in the direction along the X axis thereof. Therefore, in the image printing system and image printing system, it is possible to communicate print image data representing a desired print image via the second interface and at the same time, while communicating the print image data via the first interface in units of line data items each representing one line of the print image data, print a unitary print image formed by N copies of the print image a plurality of times at an increased speed.

Preferably, in the image printing system, the second interface enables communication via a predetermined network.

Preferably, in the printing method, the second interface enables communication via a predetermined network.

According to these preferred embodiments, the second interface enables communication via a predetermined network. Therefore, it is possible to communicate print image data representing a desired print image via the second interface through a predetermined network and at the same time communicate the print image data via the first interface in units of line data items each representing one line of the print image data, to thereby print a unitary print image formed by N copies of the print image a plurality of times at an increased speed.

Further preferably, in the image printing system, the predetermined network includes the Internet.

Further preferably, in the printing method, the predetermined network includes the Internet.

According to these preferred embodiments, the network includes the Internet, so that the second interface enables communication via the predetermined network including the Internet. Therefore, in the image printing system and printing method, it is possible to communicate print image data representing a desired print image via the second interface through the predetermined network including the Internet, and at the same time communicate the print image data via the first interface in units of line data items each representing one line of the print image data, to thereby accelerate printing of a plurality of the print images.

Further preferably, in the image printing system, the predetermined network includes a predetermined local area network.

Further preferably, in the printing method, the predetermined network includes a predetermined local area network.

According to these preferred embodiments, the network includes a predetermined Local Area Network (LAN), so that the second interface enables communication via the network including the predetermined LAN. Therefore, in the image printing system and the printing method therefor, it is possible to communicate print image data representing a desired print image via the second interface through the predetermined network including the LAN, and at the same time communicate the print image data via the first interface in units of line data items each representing one line of the print image data, to thereby accelerate printing of a plurality of the print images.

More preferably, in the image printing system, the second interface enables communication in conformity to an IEEE standard LAN-based communication protocol.

More preferably, in the printing method, the second interface enables communication in conformity to an IEEE standard LAN-based communication protocol.

According to these preferred embodiments, the second interface enables communication in conformity to the IEEE standard LAN-based communication protocol. Therefore, it is possible to communicate print image data representing a desired print image via the second interface according to the IEEE standard LAN-based communication protocol and at the same time communicate the print image data via the first interface in units of line data items each representing one line of the print image data, to thereby accelerate printing of a plurality of the print images.

More preferably, in the image printing system, the second interface enables communication in conformity to at least one of data link protocols of an Ethernet, an FDDI, and an ATM.

More preferably, in the printing method, the second interface enables communication in conformity to at least one of data link protocols of an Ethernet, an FDDI, and an ATM.

According to these preferred embodiments, the second interface enables communication in conformity to at least one of the data link protocols of the Ethernet, the FDDI, and the ATM. Therefore, it is possible to communicate print image data representing a desired print image via the second interface according to at least one of the data link protocols of the Ethernet, the FDDI, and the ATM and at the same time communicate the print image data via the first interface in units of line data items each representing one line of the print image data, to thereby accelerate printing of a plurality of the print images. It should be noted that in addition to the above data link protocols, those of Token Ring, 100VG-AnyLAN, Fiber Channel, HIPPI (High Performance Parallel Interface), IEEE1394 (Fire Wire), and so forth can be used.

The above and other objects, features, and advantages of the invention will become more apparent from the following detailed description taken in conjunction with the accompanying drawings.

DETAILED DESCRIPTION OF PREFERRED EMBODIMENT

The invention will now be described in detail with reference to the drawings showing an embodiment thereof. In the embodiment, an ink jet printer and an image printing system incorporating the same, as well as printing methods therefor, according to an embodiment of the present invention are applied to an image printing system PSYS.

Figure 1:
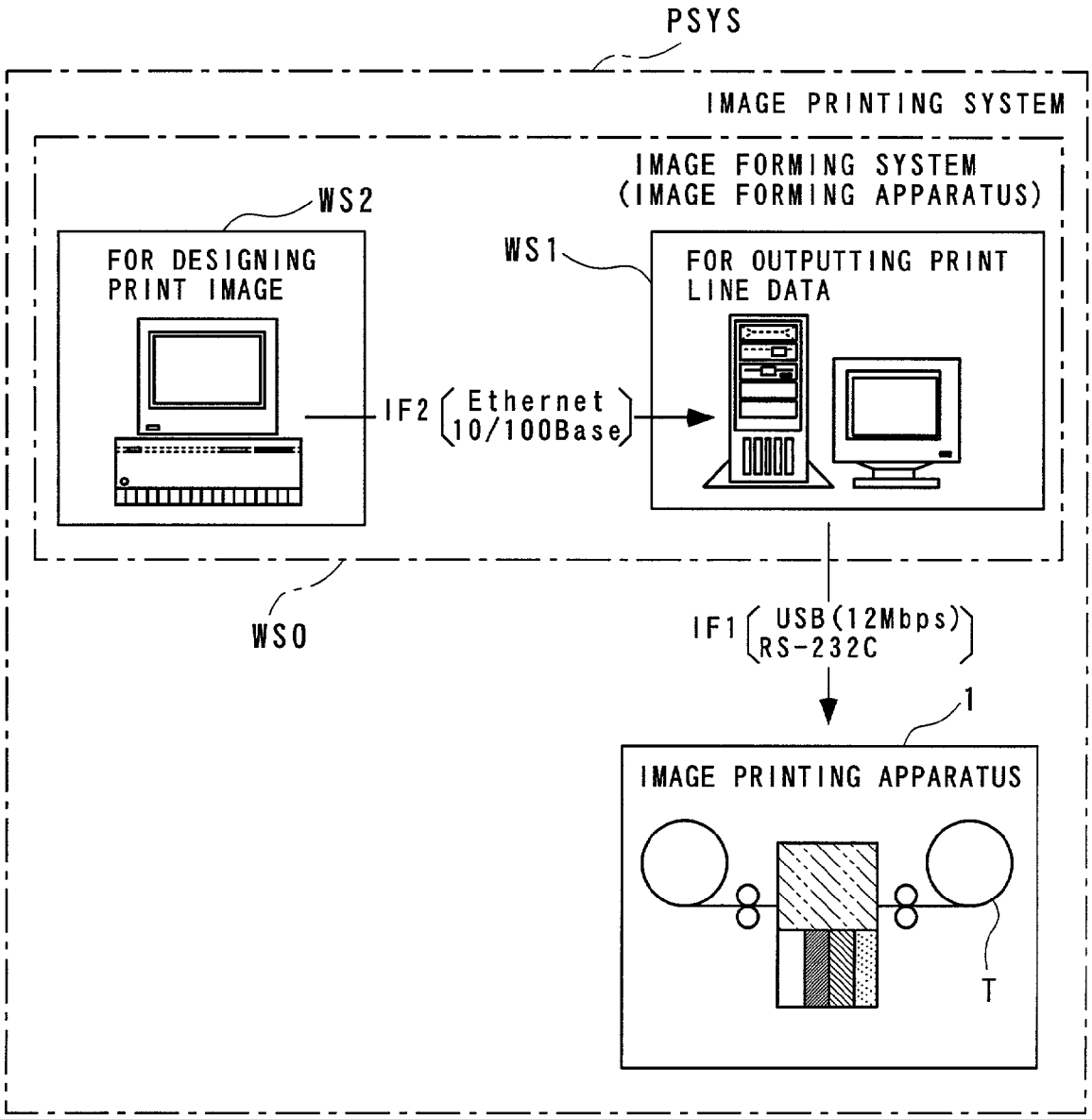
FIG. 1 is an explanatory view schematically showing the arrangement of an image printing system to which are applied an ink jet printer, an image printing system incorporating the same, printing methods therefor, according to an embodiment of the invention.

Referring first to FIG. 1, the image printing system PSYS includes am image forming system (or apparatus) WS0 including a personal computer, an engineering work station (EWS) or the like for forming print image data representing a desired print image, and the image printing apparatus 1 for printing a print image based on the print image data. The print image data formed by the image forming system WS0 is transferred (sent) to the image printing apparatus 1 via a first interface IF1 in units of line data items each representing one line of the print image data.

Figure 2:
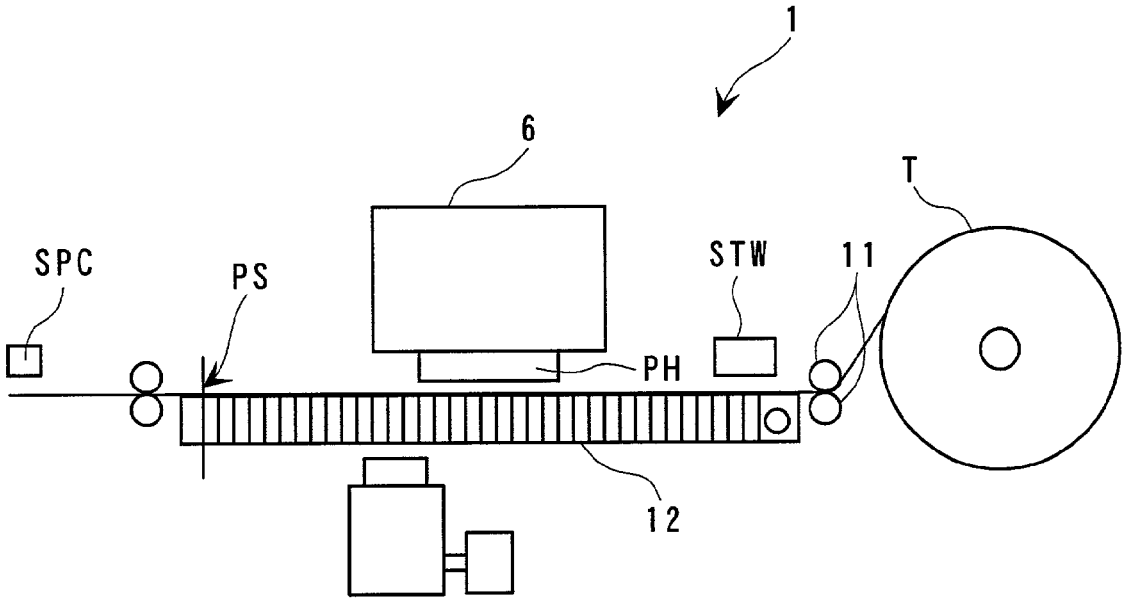
FIG. 2 is an explanatory view showing a schematic vertical cross section of a mechanical system of an image printing apparatus appearing in FIG. 1.
Figure 3:
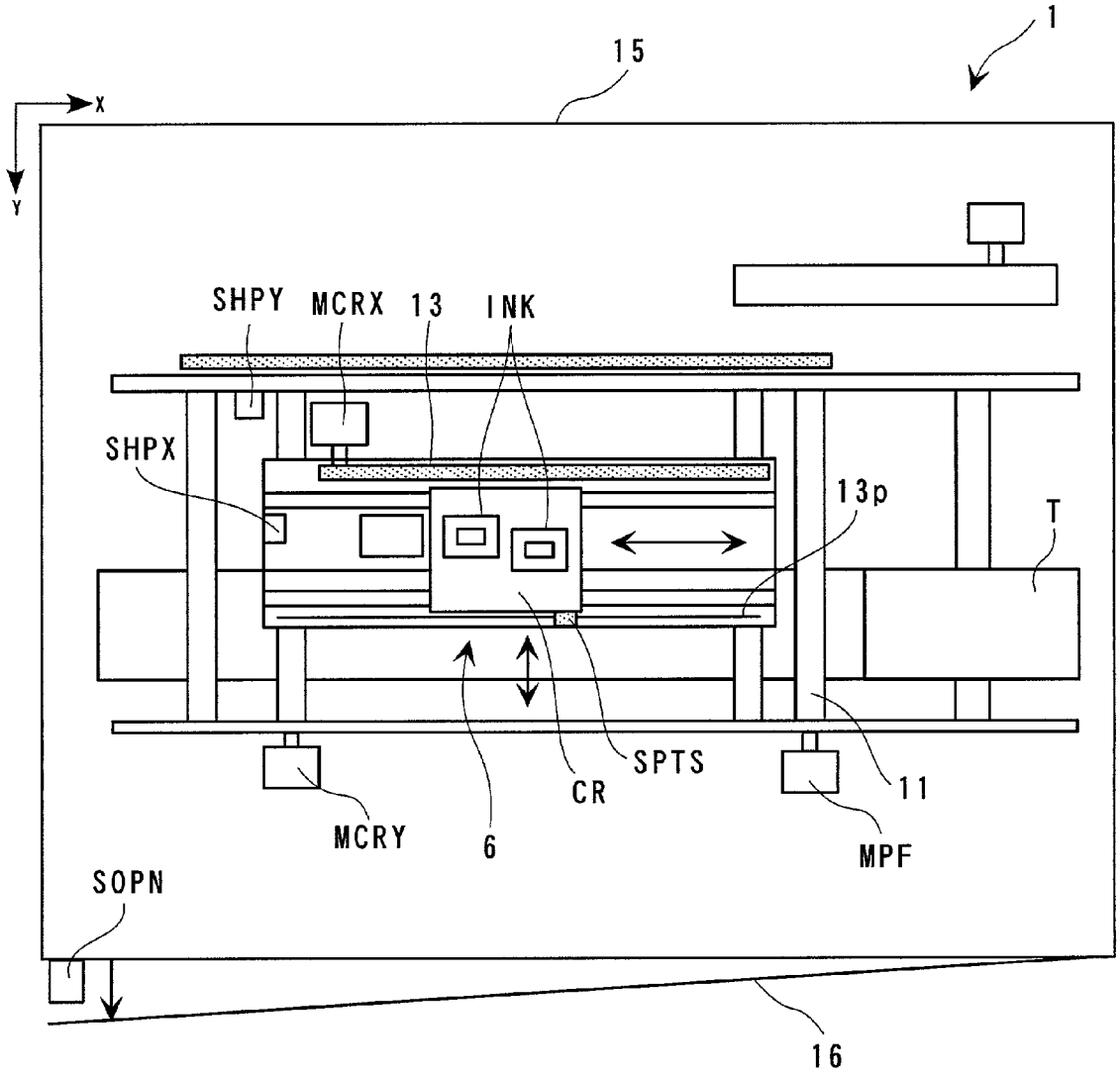
FIG. 3 is an explanatory view showing a schematic horizontal cross section of the mechanical system.

Next, as shown in FIGS. 1 to 3, in the image printing apparatus 1, a tape T supplied (mounted) in a state wound around a tape reel (on a right-hand side as viewed in the figures) is used as a print medium. A paper feed (PF) roller 11 driven by a paper feed (PF) motor MPF rolls out the tape T to an attraction unit 12 which is used as a work area for printing operation, and a print head group (ink jet head group) PH (detailed description will be given hereinafter with reference to FIGS. 6A and 6B) carried on a head unit 6 prints on the tape T as desired. The printed portion of the tape T is sequentially delivered out of the image printing apparatus 1 (in a leftward direction as viewed in FIG. 2). The attraction unit 12 is configured such that during the printing operation, it holds the tape T in a predetermined printing position by using a fan, not shown.

The tape T includes a type, such as an ordinary paper tape, which has no adhesive surface on the reverse side thereof, and a type which has an adhesive surface formed on the reverse side thereof with a peel-off paper covering the adhesive surface. As for the tape width, there are many types having different print widths in a range of approximately 50 mm to 150 mm (20 types each corresponding to every increment of 5 mm of the print width). Further, on a tape guide (or feed guide) arranged for guiding the mounting or feeding of the tape T such that the width of the tape guide can be adjusted, a tape width sensor STW is provided for detecting the tape width of the tape mounted in the image printing apparatus 1. It should be noted that as shown in FIG. 3, the following description will be given assuming that the direction of the length of the tape T is set to the direction along the X axis (hereinafter referred to as "the X-axis direction") or a main scan direction, and a direction orthogonal to the direction of the length of the tape T is set to the direction along the Y axis (hereinafter referred to as "the Y-axis direction") or a sub scan direction.

The head unit 6 includes a carriage CR carried on a main scan unit 13, an ink cartridge INK removably mounted in the carriage CR to hold inks of six colors (black (K), yellow (Y), magenta (M), cyan (C), light magenta (LM), and light cyan (LC)), and the print head group PH which is installed on a lower portion of the carriage CR such that it can be opposed to the tape T. The main scan unit 13 is driven by a sub scan carriage motor MCRY such that it can move above the top of the attraction unit 12 in the sub scan direction (Y-axis direction). Further, the carriage CR is driven by a main scan carriage motor MCRX such that it can move in the main scan direction (X-axis direction), whereby (the print head group PH of) the head unit 6 can move above the top of the attraction unit 12, i.e. above the work area for printing operation.

In this embodiment, a position within a printable area (workable area) WPA (see FIG. 12B), which is located on a downstream side of the tape T (on a left-hand side as viewed in FIGS. 2 and 3, i.e. on a side where the coordinate value "X" is small) and on a rear side (on a rear side in FIG. 2, at an upper left location in FIG. 3, i.e. on a side where the coordinate value "Y" is small) of the image printing apparatus 1, is set to a print-starting position PS. A main scan home position sensor SHPX for sensing a home position of the head unit 6 for the main scan (X side) is arranged on the carriage CR, and a sub scan home position sensor SHPY for sensing a home position of the head unit 6 for the sub scan (Y side) is arranged at a location shown in FIG. 3 (inside a casing, where an upper end of the carriage CR can be sensed).

On the main scan unit 13, a predetermined (e.g. monochrome) pattern image 13*p* is arranged such that it can be sensed optically. At a location on the carriage CR, opposite to the pattern image 13*p*, there is arranged a print timing sensor SPTS which detects the position of the carriage CR by itself by sensing the pattern of the pattern image 13*p*, for recognition of print timing. As shown in FIG. 3, the above-mentioned component parts of the image printing apparatus 1 are accommodated in a protective casing 15. It should be noted that in addition to the above-described tape width sensor STW and other sensors shown in the figures, there are provided, for instance, a protective casing opening/closing sensor SOPN which detects the opening and closing of a lid 16 of the protective casing 15 and performs an emergency stop if it is detected that the lid 16 is opened during the operation, and a paper position sensor SPC for sensing the leading edge of the tape T.

Figure 4:
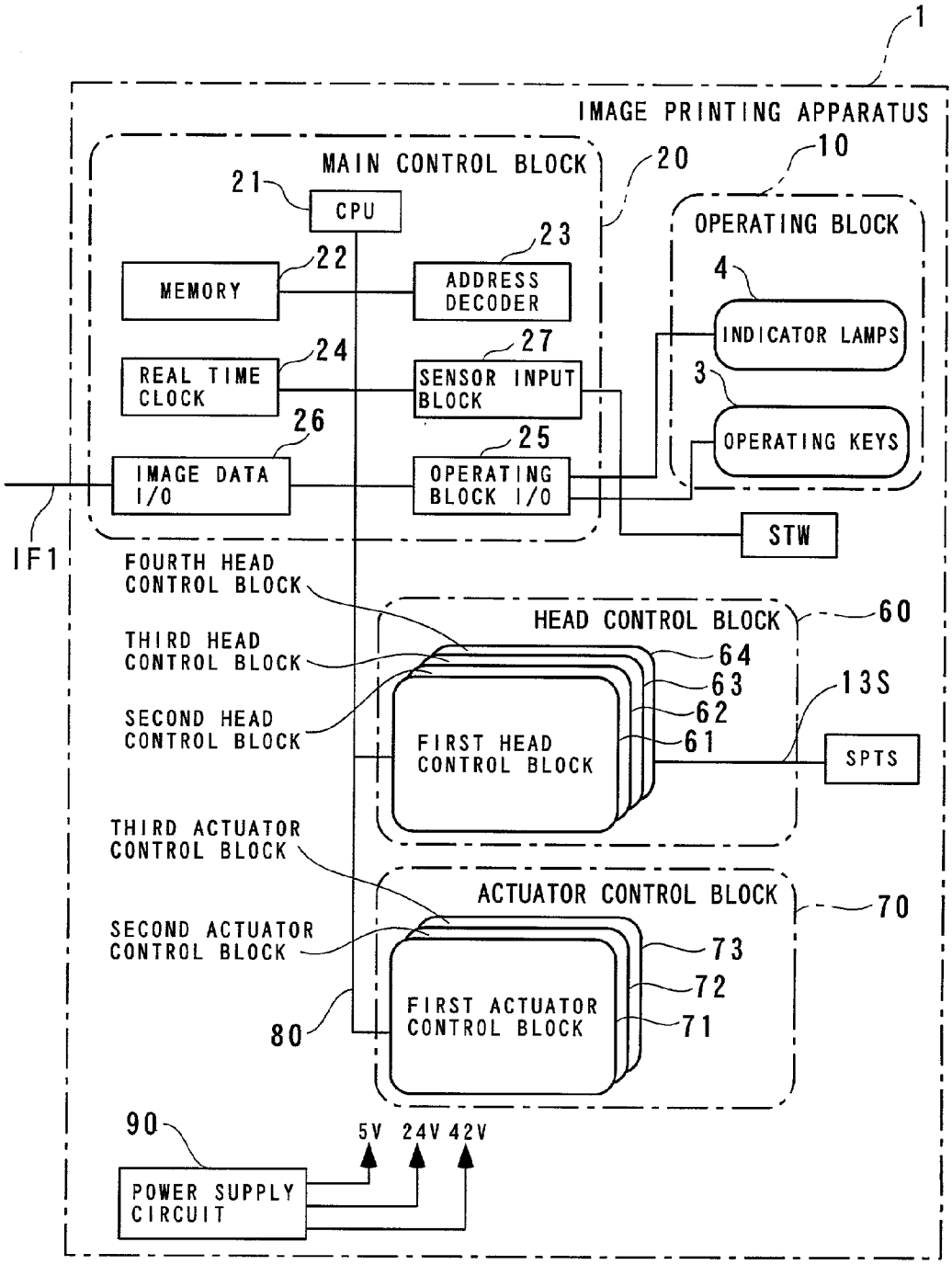
FIG. 4 is a block diagram schematically showing the arrangement of a control system of the image printing apparatus.

Next, the arrangement of the control system of the image printing apparatus 1 will be described. As shown in FIG. 4, the control system of the image printing apparatus includes an operating block 10 having indicator lamps 4 and operating keys 3 for interfacing with the user (man machine), a head control block 60 for controlling the print head 6 and component parts associated therewith, an actuator control block 70 for controlling actuators associated with the respective motors, a power supply circuit 90 for supplying power to each block, and a main control block 20 which serves as a center for controlling the blocks of the image printing apparatus 1.

The main control block 20 includes a CPU 21, a memory 22, an address decoder 23, and a real time clock 24, as well as an operating block input/output (operating block I/O) 25 for interfacing with the operating block 10, an image data input/output (image data I/O) 26 for communication with the above-mentioned image forming system WS0 via the first interface IF1 described above, and a sensor input block 27 for receiving signals from sensors, such as the tape width-detecting sensor STW, all of which are connected to each other by an internal bus (CPU bus) 80 commonly used in the image printing apparatus 1. The head control block 60 includes first to fourth head control blocks 61 to 64. Although similarly to the head control block 60, the actuator control block 70 as well has a plurality of control blocks 71 to 73, detailed description thereof is omitted here.

Figure 5:
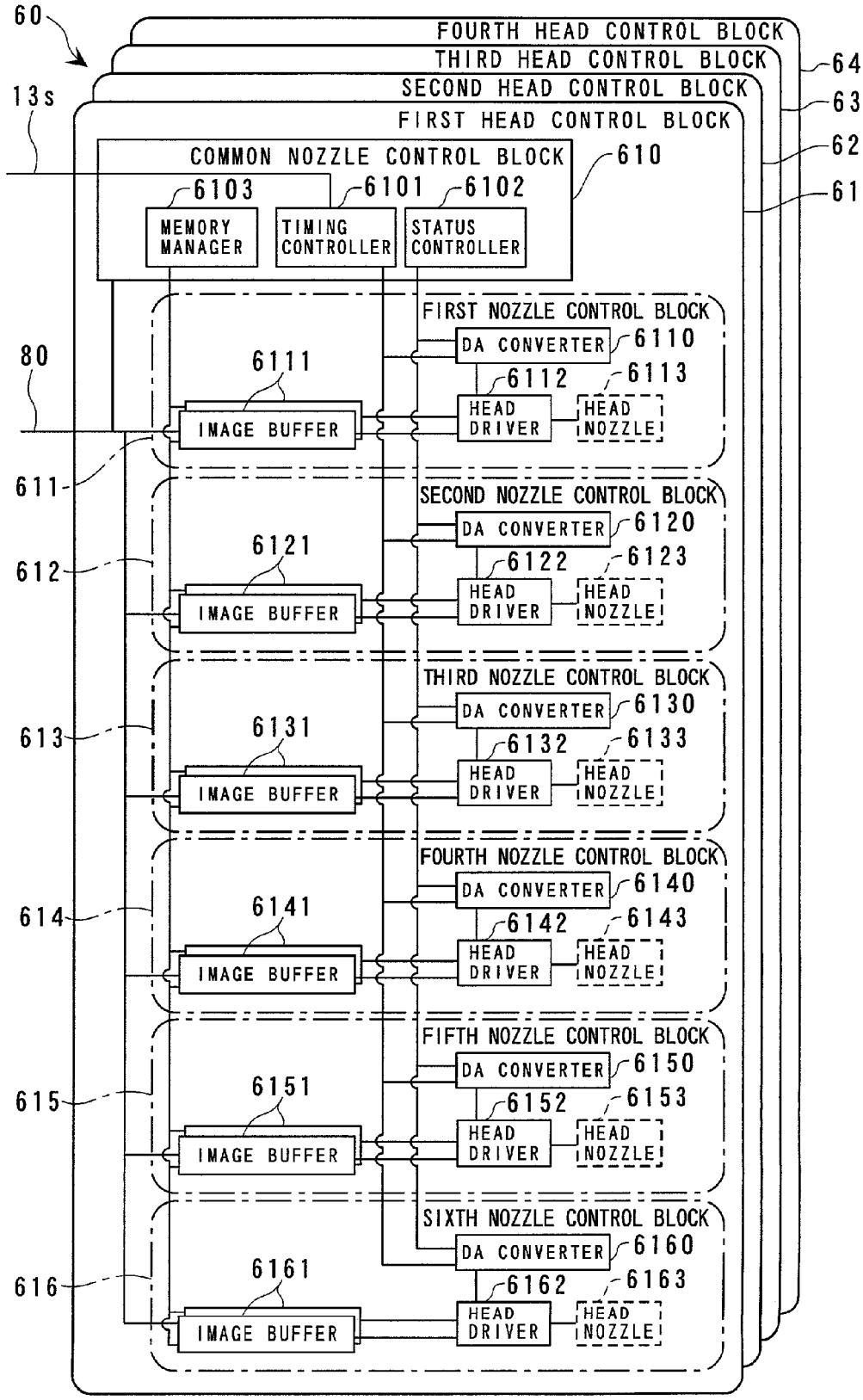
FIG. 5 is a block diagram schematically showing the arrangement of a head control block appearing in FIG. 4.

Referring to FIGS. 4 and 5, the first head control block 61 of the head control block 60 includes a common nozzle control block 610, and first to sixth nozzle control blocks 611 to 616.

The common nozzle control block 610 includes a timing controller 6101 which controls the timing of ejection of ink droplets from each nozzle of the print head group PH. This control of the timing of ejection of ink droplets is carried out in response to a detection signal (encoder signal) 13*s* indicative of the pattern of the pattern image 13*p* sensed by the print timing sensor SPTS. The common nozzle control block 610 also includes a status controller 6102 for controlling the state of each nozzle of the print head group PH, and a memory manager (M/M) 6103 for managing buffering of data in image buffers 6111, 6121, 6131, 6141, 6151, and 6161.

The first nozzle control block 611 includes a D/A converter (DAC) 6110, an image buffer 6111, and a head driver 6112 for driving a head nozzle 6113. The DAC 6110 is used for converting control signals (digital signals) from the timing controller 6101 and the status controller 6102 to the control waveforms (analog signals) of applied voltages for driving the head driver 6112 (for piezoelectric ejection). The other nozzle control blocks 612 to 616 as well are configured similarly to the first nozzle control block 611. Further, the other head control blocks 62 to 64 as well are constructed similarly to the first head control block 61.

In this embodiment, six head nozzles 6113, 6123, 6133, 6143, 6153, and 6163, all of which are controlled by the first head control block 61, are nozzle arrays e.g. each comprised of 180 nozzles. Each of them is provided for ejecting an ink of one of the six colors (black (K), yellow (Y), magenta (M), cyan (C), light magenta (LM), light cyan (LC)).

Figure 6A:
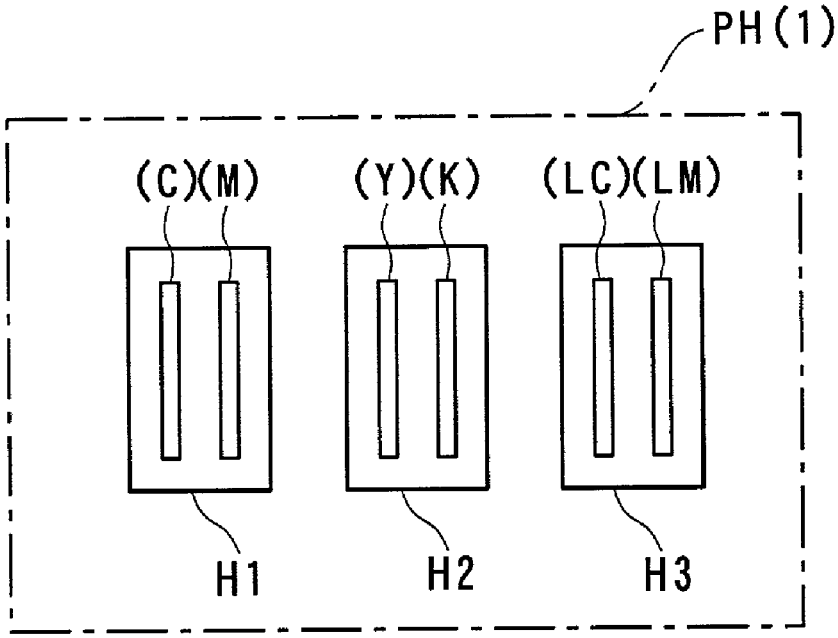
FIGS. 6 A and 6B are explanatory views which are useful in explaining the function and arrangement of print heads and head nozzles thereof mounted in a head unit.
Figure 6B:
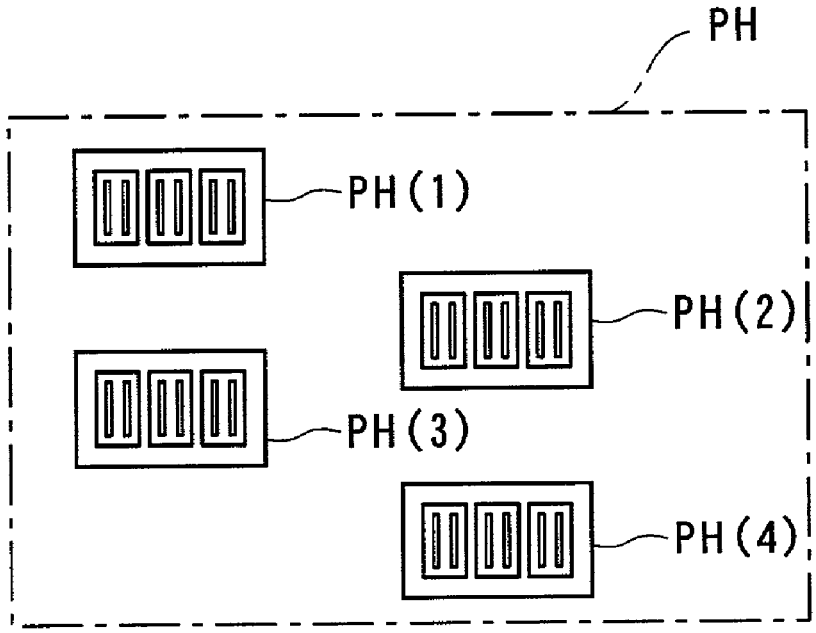

For instance, let it be assumed that as shown in FIG. 6A, three print heads H1 to H3 each having two nozzle arrays arranged therein are set to a print head group PH(1) for being controlled by the first head control block 61, and print head groups PH(2), PH(3), and PH(4) constructed similarly to the print head group PH(1) are for being controlled by second to fourth head control blocks 62 to 64, respectively. Then, as shown in FIG. 6B, the print head group PH in the present embodiment includes the print head groups PH(1) to PH(4), and hence configured to have 3 by 4 heads (12-head configuration).

It should be noted the print head group PH may be configured to have e.g. 3 by 6 heads (18-head configuration), or 3 by 3 heads (9-heads configuration) such that the head control blocks can be changed in number according to a change in the specifications of the image printing apparatus 1. Further, in this case, the image printing apparatus 1 may be configured such that e.g. by forming each head control block by using one circuit board (head control board), the apparatus 1 can be subjected to construction modification (specification change) simply by inserting or drawing (mounting or removing) head control boards.

Next, the speed-up of printing of the image printing apparatus 1 will be described. First, the image printing apparatus 1 includes four print head groups PH(1) to PH(2), as described above with reference to FIG. 6B. More specifically, the print head groups (1) to (4) each have six nozzle arrays for respective six colors. Each nozzle array is formed of 180 (=M) nozzles arranged in the Y-axis direction. In other words, when considering print nozzles of one color, by using N (four in the illustrated example) print heads) capable of printing 180 dots or 180 dot lines in the Y-axis direction (those with single color-adapted nozzle arrays are sufficient for the present explanation), i.e. by employing a multi-head structure, it is theoretically possible to print 4×180 dots in the Y-axis direction (however, since they are allocated in a partially overlapping manner, the total number of the printable dots is smaller than this theoretical value.)

Figure 7A:
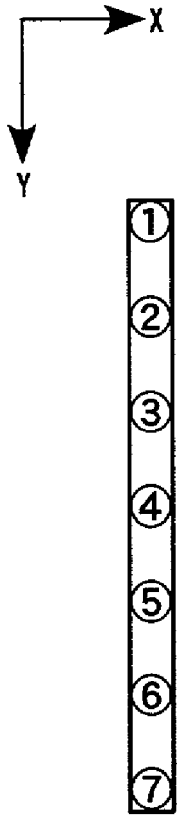
FIGS. 7A and 7B are explanatory views schematically showing a simplified representation of a combined nozzle array of head nozzles for a single color of a plurality of print heads when a multi-head type head unit is employed, in which a print head is simplified as one having a nozzle array formed by one line of seven head nozzles.
Figure 7B:
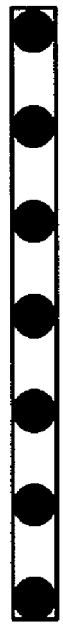

For simplicity of explanation based on a schematic view, it is assumed here that one of the six nozzle arrays in each of the four (=N) print head groups PH(1) to PH(4) (e.g. a nozzle array for cyan (C)) represents the four print head groups PH(1) to PH(4), and further, the number of nozzles is also reduced for simplification to 7 as indicated by circled numerals 1 to 7 in FIG. 7A. Further, as shown in FIG. 7B, each nozzle is simply represented by a black-filled circle, and the interval between adjacent nozzles (nozzle pitch) is assumed to be one dot in a resolution of 180 dot/inch.

Here, the amount of shift in position of a dot that can be printed by the same nozzle, in the Y-axis direction (sub scan direction) is defined as a head moving pitch P, and the pitch of head nozzles in the Y-axis direction (nozzle interval) is defined as a nozzle pitch D, and they are expressed in units of dots. However, in the following description, for compatibility of the apparatus up to a resolution of 1400 dpi, one dot in 1440 dpi is set to a unit. Therefore, the nozzle pitch D corresponding to the nozzle interval 180 dpi is equal to 8 dots.

In the following, a n-th printing pass is expressed by using the number n, as in "Pass=n", and designated in figures by a boxed number n. Further, by using Step which represents the distance "t" of each nozzle from a reference position (position to be assumed by a nozzle of encircled number 1 (hereinafter simply referred to as "Nozzle No. 1") during a first printing pass (Pass=1 in the figure), the position of a given point in the Y-axis direction is described as in "Step=t", where t is a variable indicative of the number of dots. The Step or the value of the variable t corresponds to a numerical value related to step control on the sub-scanning carriage motor MCRY.

Figures 8A, 8B, 8C:
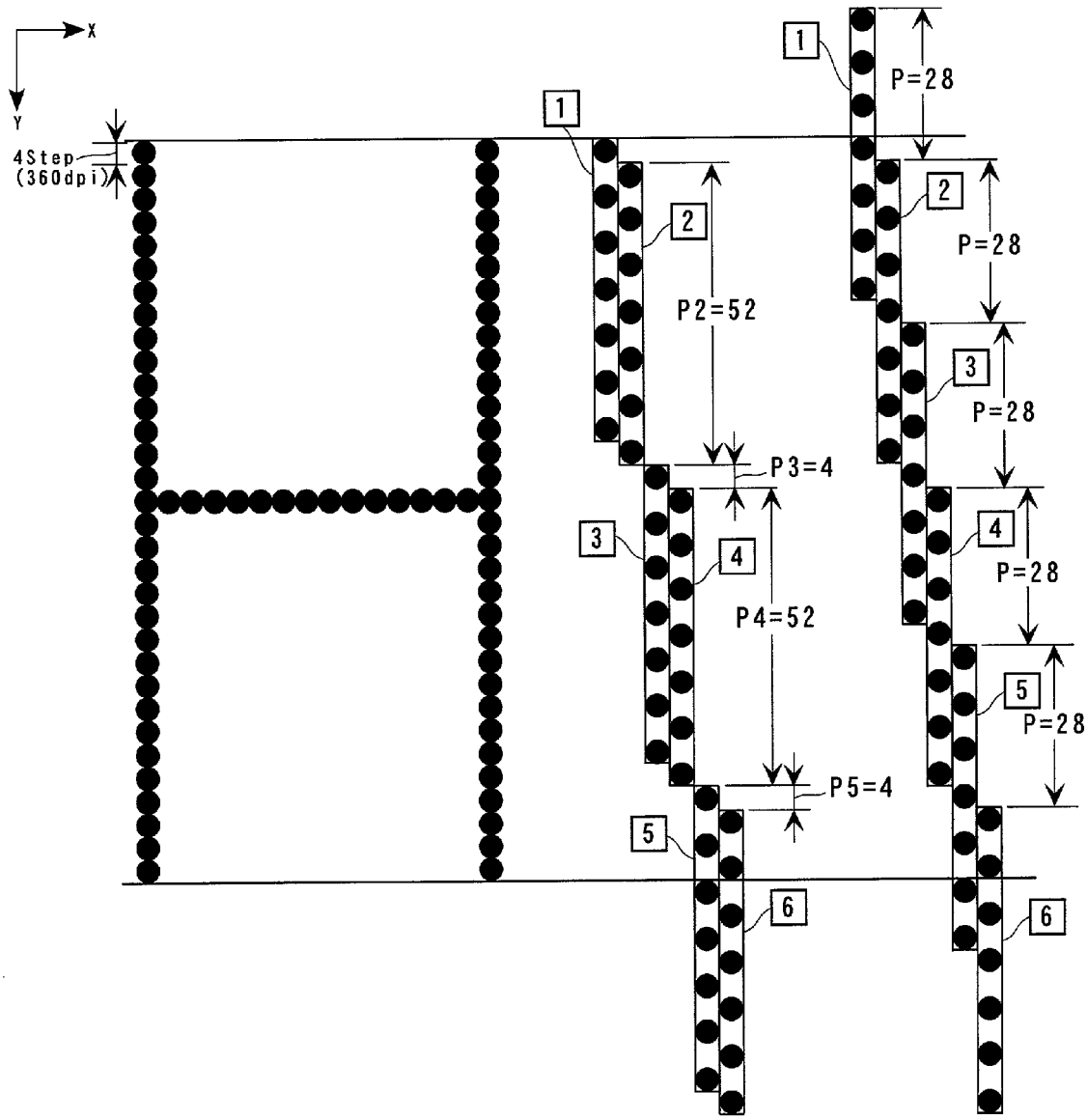
FIGS. 8A to 8C are explanatory views which are useful in explaining how a print image of a letter "H" is printed, by a print head scanning in the Y-axis direction with a certain head moving pitch, based on the simplified print head shown in FIGS. 7A and 7B.

For example, as shown in FIGS. 8A to 8C, when a letter "H" with a width of 32 dots in the Y-axis direction is printed in a resolution of 360 dpi, according to the printing method shown in the FIG. 8B, first, by a first printing operation (ejection of ink dots) (by a scan in the X-axis direction), i.e. Pass=1 which is designated in the figure by a boxed "1", it is possible to print at positions of Step=0, 8, 16, 24, 32, 40, 48, by the nozzles 1 to 7, and then, after moving the print head by a head moving pitch P1=4, by a second printing operation (Pass=2, indicated by a boxed number "2"), it is possible to print at positions of Step=4, 12, 20, 28, 36, 44, 52. Further, this completes all printing up to Step 52, so that the print head is moved in the Y-axis direction by a head moving pitch P2=52, at a third printing operation (hereinafter, each printing operation of ejection of ink dots is simply described e.g. as "Pass=3"), it is possible to print at positions of Step=56, 64, 72, 80, 88, 96, 104.

It should be noted that when printing the letter having the same size in the Y-axis direction as the one described above in a resolution of 720 dpi (with a dot width of 64 dots in the Y-axis direction), after the first printing operation, the print head is moved by a first head moving pitch P1=2, and at Pass=2, it is possible to print at positions of Step=2, 10, 18, 26, 34, 42, 50, and then by moving the same by a head moving pitch P2=2, at Pass=3, it is possible to print at positions of Step=4, 12, 20, 28, 36, 44, 52. Thereafter, by moving the print head at a head moving pitch P3=2, it is possible to print at positions of Step=6, 14, 22, 30, 38, 46, 54. This completes all printing up to Step=54, and next, by moving the print head in the Y-axis direction by a head moving pitch P4=50, at Pass=5, it is possible to print at positions of Step=56, 64, 72, 80, 88, 96, 104.

In the case of the above printing method (second printing method), printed dots by the same printing nozzle are adjacent to each other, as described above with reference to FIG. 8B when some nozzle is faulty, the print quality is markedly degraded. Further, as described above, the head moving pitch is not constant.

In contrast, in a printing method shown in FIG. 8C, it is possible to set the head moving pitch to a constant value e.g. to P=28. In the case of this first printing method, as described in detail in the above-mentioned Japanese Laid-Open Patent Publication (Kokai) No. 10-250120 (of Japanese Patent Application No. 09-339361 filed by the present assignee), the position R of printable dots (indicated by the number or value of Step) is can be expressed by the following equation (1):

$$R=(P+k)\times j+D\times i \tag{1}$$

where j represents a variable indicative of the position of the immediately preceding printing operation in a sequence of printing operations being carried out (when an n-th printing operation is carried out, j=n−1 (i.e. j=0, 1, 2, . . . ), and i represents a correction value for accommodating a deviation of the head moving pitch P in actual printing operations from an integral multiple of dots or from a value satisfying the conditions for printing all dots. Assuming that P represents a pitch including the correction value k, the above equation (1) can be expressed by the following equation (2):

$$R=P\times j+D\times I \tag{2}$$

For more details of the explanation of this equation, the above Publication, incorporated herein by reference, should be referred to.

Figures 10A, 10B:
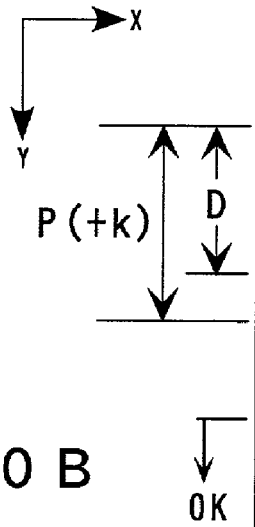
FIG. 10A is a diagram showing a variable i corresponding to a nozzle and applied to an equation for calculating the position of a printable dot, a variable j corresponding to a printing pass (indicative of the immediately preceding printing pass), and the value indicative of the position of a printable dot calculated by the equation depending on values of the above variables, provided that a nozzle pitch P of the printing head is equal to 4, and a head moving pitch in a relative scan in the Y-axis direction being equal to 3.
FIG. 10B is a diagram showing the relationship between the head moving pitch P, the nozzle pitch P, the printing pass Pass, a variable t indicative of the value of a position Step at every dot from the reference position, and a pattern of printable dots by the nozzles.

For instance, as described hereinabove in the section of Prior Art with reference to FIG. 10A, for example, in the case where the head moving pitch P is 4, and the nozzle pitch D is 3 (and hence the printable dot R=4j+3i), if four nozzles designated by Nozzle No. 1 to Nozzle No. 4 are used, as shown in 10B, from Step=6, it becomes OK (possible to print dots in a continuous manner without forming a break or unprinted dot) and printing can be effected in a pattern as shown in FIG. 10B.

Further, in the case of the FIG. 8C example, the head moving pitch P is 28 (P=28), and the nozzle pitch D is 8 (D=8) (i.e. printable dot R=28j+8i), as shown in the figure, at Pass=1, it is possible to print by using the nozzles Nos. 1 to 7, at positions Step=0, 8, 16, 24, 32, 40, 48, and by using only the nozzles No. 4 to 7 alone, it is possible to print at positions of Step=24, 32, 40, 48.

Subsequently, after moving the print head in the Y-axis direction by the head moving pitch P=28, at Pass=2, it is possible to print at positions of Step=28, 36, 44, 52, 60, 68, 76. Then, after moving the print head in the Y-axis direction again by the head moving pitch P=28, at Pass=3, it is possible to print at positions of Step=56, 64, 72, 80, 88, 96, 104. Similarly, at Pass=4, it is possible to print at positions of Step=84, 92, 100, 108, 116, 124, 132. In short, from Step=24, it becomes OK (possible to print dots in a continuous manner without forming a break or unprinted dot), and by setting the head moving pitch P to a constant value (28 dots), printing can be effected in a pattern shown therein.

Figures 9A, 9B, 9C:
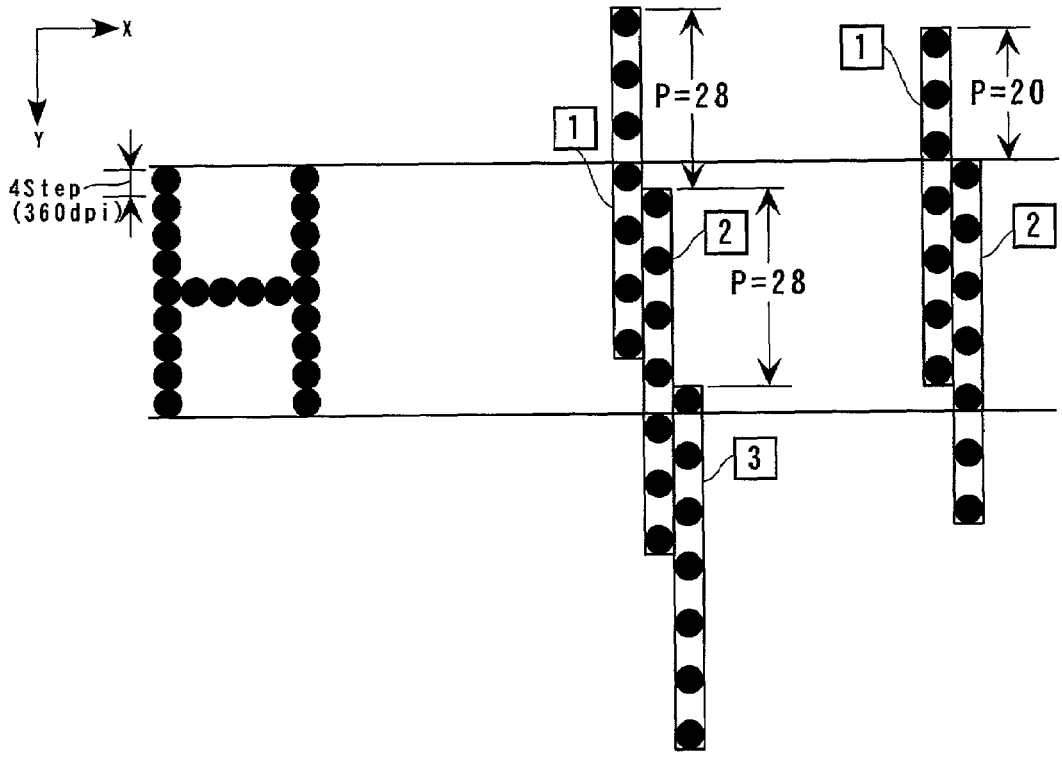
FIGS. 9A to 9C are explanatory views similar to FIGS. 8A to 8C, in which the width of a print image is small.

By the way, if the printing method described hereinabove with reference to FIG. 8C is employed e.g. for printing one vertical line of a letter "H" with a width of 9 dots in the Y-axis direction as shown in FIG. 9A in a resolution of 360 dpi, it is possible to print by three printing operations (Pass=1 to 3). More specifically, since the head moving pitch P=28 and the nozzle pitch D=28 are employed, at Pass=1, it is possible to print at positions of Step=24, 32, 40, 40 by using the nozzles No. 4 to No. 7 out of all the nozzles No. 1 to No. 7, and at Pass=2, it is possible to print at positions of Step=28, 36, 44, 52, 60, 68, 76 by using all the nozzles No. 1 to No. 7. Similarly, at Pass=3, it is possible to print at locations Step=56, 64, 72, 80, 96, 104.

However, in this case, positions which have to be actually printed are only 9 dots corresponding to Step=24, 28, 32, 36, 40, 44, 48, 52, 56. Therefore, not only printing at positions Step=0, 8, 16 by the nozzles No. 1 to No. 3 at Pass=1, but also printing at positions Step=60, 68, 76 by the nozzles No. 5 to No. 7 at Pass=2 and at positions Step=64, 72, 80, 88, 96, 104 by the nozzles No. 2 to No. 7 at Pass=3 are not actually reflected in printing, i.e. ejection of ink is not effected. That is, in these cases, the print head-moving operation for enabling the print head to scan for printing at these positions becomes useless.

To eliminate such inconvenience, the image printing apparatus 1 according to the present embodiment shifts the reference position t=0 and sets the head moving pitch P to 20 (i.e. setting the printable dot R=20j+8i), whereby at Pass=1 by using the nozzles No. 4 to No. 7, printing is carried out at positions Step=24, 32, 40, 48, and at Pass=2, by using the nozzles No. 1 to No. 5, at positions Step=20, 28, 36, 44, 52. This completes the printing of all (9) necessary dots at Pass=2, whereby the number of printing passes can be reduced.

When a letter having the same size in the Y-axis direction (with a width of 18 dots in the Y-axis direction) is printed in a resolution of 720 dpi, assuming that the head moving pitch P is 6 (i.e. printable dot R=6j+8i), at Pass=1, it is possible to print at positions of Step=16, 24, 32, 40 by Nozzle No. 3 to Nozzle No. 6 out of the positions of Step=0, 8, 16, 24, 32, 40, 48 by Nozzle No. 1 to Nozzle No. 7, at Pass=2, it is possible to print at positions of Step=14, 22, 30, 38, 46 by Nozzle No. 2 to Nozzle No. 6 out of the positions of Step=6, 14, 22, 30, 38, 46, 54 by Nozzle No. 1 to Nozzle No. 7, at Pass=3, it is possible to print at positions of Step=12, 20, 28, 36, 44 by Nozzle No. 1 to Nozzle No. 5 out of the positions of Step=12, 20, 28, 36, 44, 52, 60 by Nozzle No. 1 to Nozzle No. 7, and at Pass=4, it is possible to print at positions of S=18, 26, 34, 42 by Nozzle No. 1 to Nozzle No. 4 out of the positions of Step=18, 26, 34, 42, 50, 58, 66 by Nozzle No. to Nozzle No. 7. In short, from Step=12, it becomes OK (possible to print dots in a continuous manner without forming a break or unprinted dots).

As described above, the image-printing apparatus 1 includes the print head PH having M nozzles(M is an integer equal to or larger than 2: in the illustrated example, M=7) capable of printing M dots simultaneously at a predetermined nozzle pitch D (D=8 in the illustrated example) in the Y-axis direction, and prints a print image (letter "H" in the above example) on a tape T (print medium), by scanning the print head relative to the tape T in the X-axis direction and the Y-axis direction.

In this case, the print image width indicative of the width of a print image in the Y-axis direction (in the example of FIGS. 8A to 8C, 32 dots; in the example of FIGS. 9A to 9C, 9 dots) is determined, and based on the determined print image width, the head moving pitch P in relative scan in the Y-axis direction (P=28, in the examples of FIGS. 8C and 9B; P=20, in the example of 9C) is determined.

In determining the head moving pitch P, the amount of scanning uselessly carried out in the Y-axis direction, i.e. the amount of useless printing operation can be reduced by determining the number of required printing passes such that it becomes the minimum. This determination can be made in the following manner: The number of nozzles of a print head of each ink jet printer is determined in advance or fixed, and their nozzle pitch is also fixed. Therefore, for each value of the nozzle pitch P, concerning the number of nozzles inherent to the printer, data of tables shown in FIG. 10A are formed by using the above equation (2) and stored as lookup table data in a predetermined storage device in advance. When a print image width is determined as described above, from the tables, there is selected one containing a successive sequence of numerical values of R (values in the grids in FIG. 11A table) the number of which corresponds to the number of dots corresponding to the print image width, and in which the largest printing pass number associated with the successive sequence of numerical values of R is the smallest of the tables, whereby the print image can be printed at the smallest number of printing passes. The value of a head moving pitch of the thus selected table becomes the optimum head moving pitch P for the image print width. This enables the print head PH to be moved relative to the tape T at a suitable head moving pitch P, whereby the amount of scanning uselessly carried out in the Y-axis direction, i.e. the amount of useless printing operation can be reduced to increase the efficiency of printing, thereby increase the printing speed. In this case, the value of Step at which printing should be started corresponds to the smallest value of the successive sequence of numerical values of R, and hence a nozzle which should eject the dot corresponding to this value of Step can be also determined from the table. Then, the print head is moved in advance to a position in which Nozzle No. 1 corresponds to the reference position t=0 of the print head, and then printing can be started.

In this case, a unitary printable width in the Y-axis direction indicative of the width of an area which can be printed during a single printing pass can be determined based on the length (nozzle array length) between M (=7) nozzles at respective opposite ends of an array of the nozzles PH. In the above example, the nozzle pitch corresponds to one dot in the resolution of 180 dpi, and hence the unitary printable width is 4 dots (equivalent to 4 Steps)×32=52 dots (equivalent to 52 Steps). On the other hand, the print image in the FIGS. 8A to 8C example has a print image width of 32 dots by 360 dpi, and hence corresponds to 4 dots (equivalent to 4 Steps)×32=128 dots (equivalent to 128 Steps). Further, the print image in the FIGS. 9A to 9C example has a print image width of 9 dots by 360 dpi, and hence corresponds to 4 dots (equivalent to 4 steps)×9=36 dots (equivalent to 36 steps).

Then, by comparing the unitary printable dot width with the print image width, it is possible to determine the head moving pitch P based on the results of the comparison. For instance, compared with a 52 dots (equivalent to 52 Steps)

of the unitary printable width, the printable width in FIGS. 8A to 8C is 128 dots (equivalent to 128 Steps), and that in FIGS. 9A to 9C is 36 dots (equivalent to 36 Steps). Therefore, it is easy to employ different head moving pitches between the case of the unitary printable width is equal to or larger than print image width (FIG. 9C case) and the case of the unitary printable width is smaller than print image width (FIG. 8C case), whereby the amount of useless printing operation can be reduced in dependence on the width of a print image, to thereby increase the printing speed. However, it goes without saying that by employing the above-described method of using the tables, this comparison process can be dispensed with.

Further, in the image-printing apparatus 1, based on the relationship between the nozzle pitch D of the print head PH and the resolution of the print image, the head moving pitch P is adjusted. Although in the FIG. 9C example, the print image has the same size in the Y-axis direction, when the resolution is 720 dpi, the head moving pitch P is set to 6 (printable dot R=6j+8i). More specifically, the head moving pitch P can be determined by considering not only the width of a print image but also the resolution, whereby the amount of useless printing operation can be reduced in dependence on the width of a print image, to thereby increase the printing speed.

It should be noted that in the image printing apparatus 1, a print image data representing a print image is formed and stored by the image forming system WS0, and received via the first interface IF1, so that as will be described hereinafter with reference to FIGS. 11A to 11C, a print image width of a print image DS having K dots in the Y-axis direction, where K is equal to or larger than 2, is K dots in the resolution of the print image DS, and with reference to the print image data or by receiving information of K, the print image width can be determined.

Further, the print image printing apparatus 1 includes the tape width-detecting sensor STW, as described hereinabove, and therefore, the width of a printable area corresponding to the detected tape width (print medium width) may be set to a default print image width (maximum printable width). Further, at the time the tape T is mounted, the width of a tape, the kind of the tape, a print image width itself, or a numerical value of the head moving pitch itself may be directly inputted by the operating key 3 of the operating block 10.

In the image printing apparatus 1, as described above with reference to FIGS. 1 and 4, the print image data formed by the image forming system WS0 is received via the first interface IF1. In this embodiment, the print image data is sent from the image forming system WS0 to the image printing apparatus 1 via the first interface IF1 in units of line data items each representing one line of the print image data. For instance, as shown in FIG. 11A, in the case of a print image DS of J dots, where J is an integer equal to or larger than 2, in the direction along the X axis by K dots, where K is an integer equal to or larger than 2, in the direction along the Y axis, line data items of the print image data representing the print image DS each representing one line of J dots arranged in the direction along the X axis, are sequentially received from the image forming system WS0 via the first interface IF1, whereby K line data items corresponding to K lines in the direction along the Y axis are sequentially received.

Figure 11A:
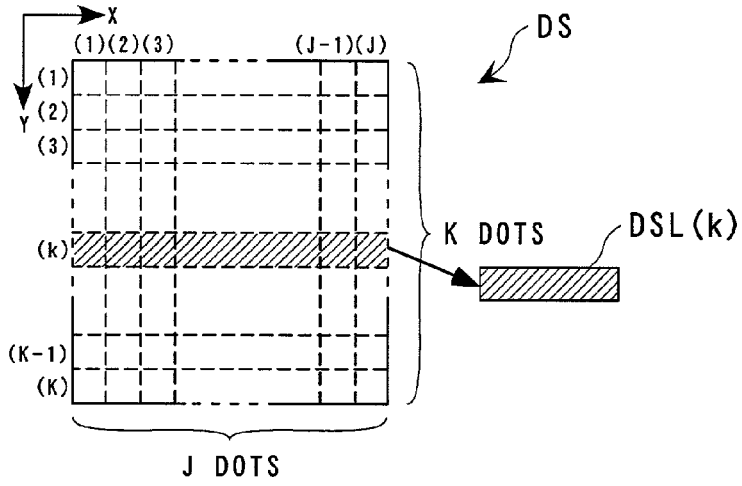
FIGS. 11A to 11C are explanatory views which are useful in explaining the relationship between a print image, print image data, a k-th short line data item, and a k-th long line data item.
Figure 11B:
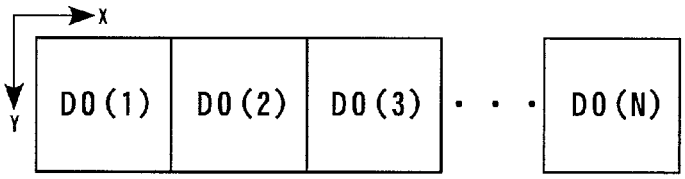
Figure 11C:
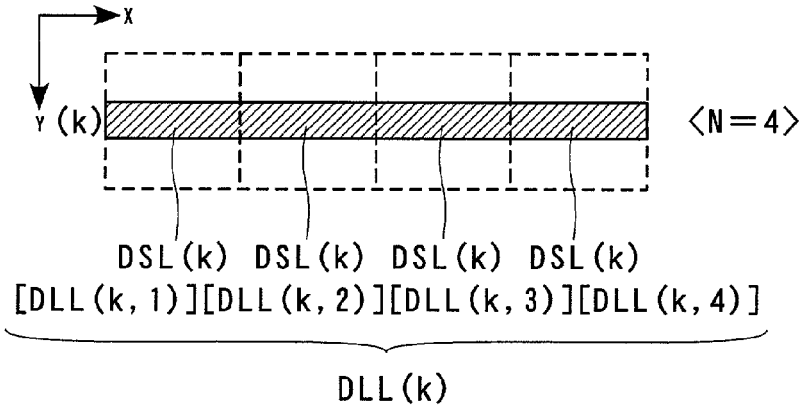

Here, let it be assumed that as shown in FIG. 11A, a k-th line data item (k is an arbitrary integer defined as $1 \leqq k \leqq K$) of the K line data items (corresponding to the K lines) of the print image DS is set to k-th short line data DSL(k). In the image printing apparatus 1, when the k-th short line data DSL(k) is received by the image data I/O 26, the k-th short line data DSL(k) is transmitted to the head control block 60 via the internal bus 80. When the head control block 60 has received the k-th short line data DSL(k), the head control block 60 stores, based on information as to the position (i.e. k) of the received data in the print image DS and a designated color (gradation value of a designated color) (given by a command from the CPU 21 or determined by itself), the k-th short line data DSL(k) in a corresponding image buffer of one of the head control blocks (e.g. in the image buffer 6111 of the first head control block 61).

After the k-th short line data DSL(k) has been stored, in the image printing apparatus 1, N copies of the k-th short line data DSL(k) are sequentially arranged side by side in the same image buffer (e.g. the image buffer 6111), whereby k-th long line data DLL(k) is formed which represents one line of J×N dots formed by arranging N times one line of J dots in the direction along the X axis. For instance, if N=4, as shown in FIG. 11C, the k-th long line data DLL(k) is formed which represents one line of J×4 (=N) dots formed by arranging 4 times one line of J dots in the direction along the X axis.

Then, one line of J×N dots (N=4 in the above example) represented by the k-th long line data DLL(k) formed as above is set to a k-th line and printed on the tape (print medium) T in the direction along the X axis thereof. In this case, after the k-th line data (k-th short line data) DSL(k) has been received, N copies of the k-th line data item can be prepared to form the k-th long line data DLL(k), and one line of J×N dots can be printed whenever each line data item representing one line of J dots is received, without any need to await reception of all the K line data items, that is, reception of the whole print image data. That is, the communication of print image data and printing of a plurality of print images formed thereafter based on the print image data can be performed by parallel processing.

Figure 12A:
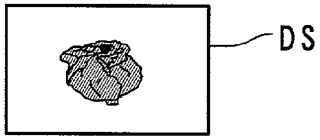
FIG. 12A is a view showing an original print image based on which a unitary print image is formed.
Figure 12B:
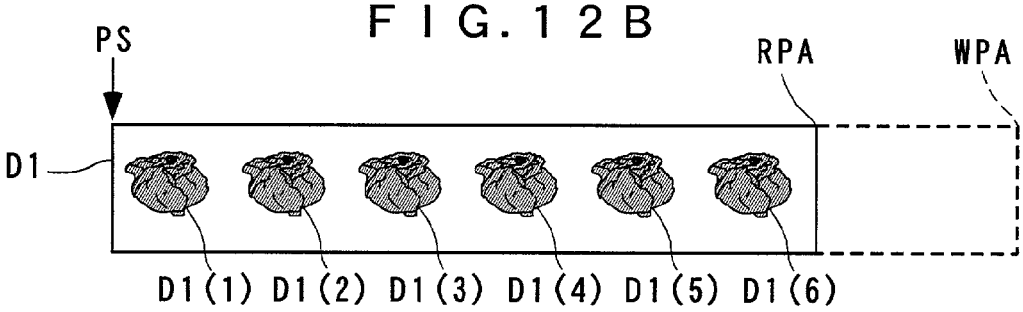
FIG. 12B is a view showing the unitary print image formed by printing a group of a plurality of (six) copies of the print image by one printing operation.

Now, in the image printing apparatus 1 according to the present embodiment, the print count N of copies of the print image to be printed can be designated by using one of the operating keys 3. This makes it possible to easily create the k-th long line data DLL(k) representing one line of J×N dots, based on the k-th short line data DSL(k) representing one line of J dots. Therefore, for instance, when the same six print images DS as shown in FIG. 12A are desired to be printed, by designating the print count N=6, it is possible to print six print images D1(1) to D1(6) each of which is identical to the print image DS, as shown in FIG. 12B.

Figure 13A:
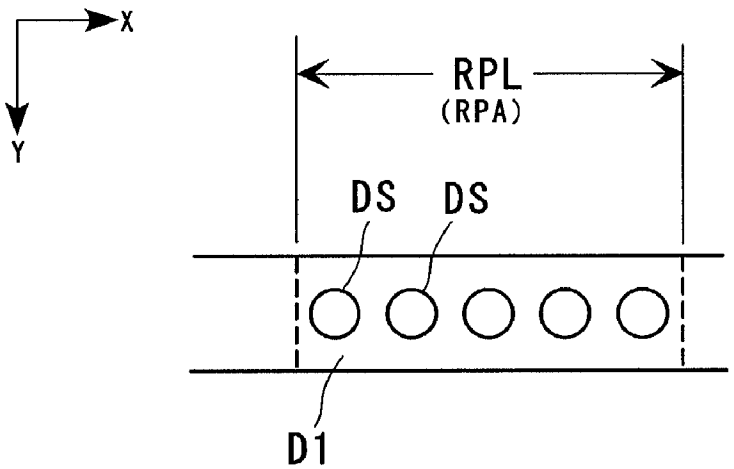
FIG. 13A is a view showing a unitary print image formed of five print images.

An image in which six copies D1(1) to D1(6) of the above print image DS are arranged in a line is defined here as a unitary print image D1, i.e. a unit of image for one printing operation. Printing of a number of copies of the print image DS or the unitary print image D1 may be effected by printing a number of copies of the unitary print image D1 in the X-axis direction. For instance, as shown in FIG. 13A, when a large number of copies of a row of five copies of the single print image DS are printed, in the actual print area RPA within the printable area (workable area) WPA, (1) the unitary print image D1 is printed, and (2) the tape T is fed in the X-axis direction by the length corresponding to the length RPL (actual unitary print length) in the X-axis direction. These operations (1) and (2) are repeatedly carried out. This makes it possible to print a large number of copies of the unitary print image D1 in the X-axis direction (direction along the length of the tape T).

Figure 14A:
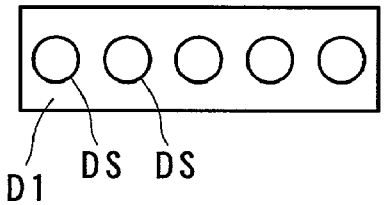
FIGS. 14A and 14B are views similar to FIGS. 13A and 13B, in which the print medium is fed in the Y-axis direction.
Figure 14B:
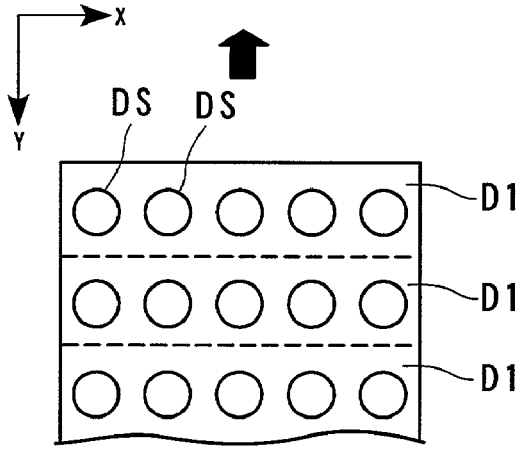

By the way, when similar printing is carried out by feeding the tape T in the Y-axis direction, this can be illustrated as shown in FIGS. 14A and 14B. This can be effected by the printing apparatus (ink jet printer) disclosed in the Japanese Laid-Open Patent Publication (Kokai) No. 10-250120 of Japanese Patent Application No. 09-339361 filed by the present assignee, referred to hereinabove. Compared with this, when a print image is printed on the tape (print medium) while feeding the tape T in the X-axis direction, as in the case of the image printing apparatus 1 according to the present embodiment, there arises a problem which has not been caused in the case of printing carried out while feeding the tape T in the Y-axis direction.

Figure 15:
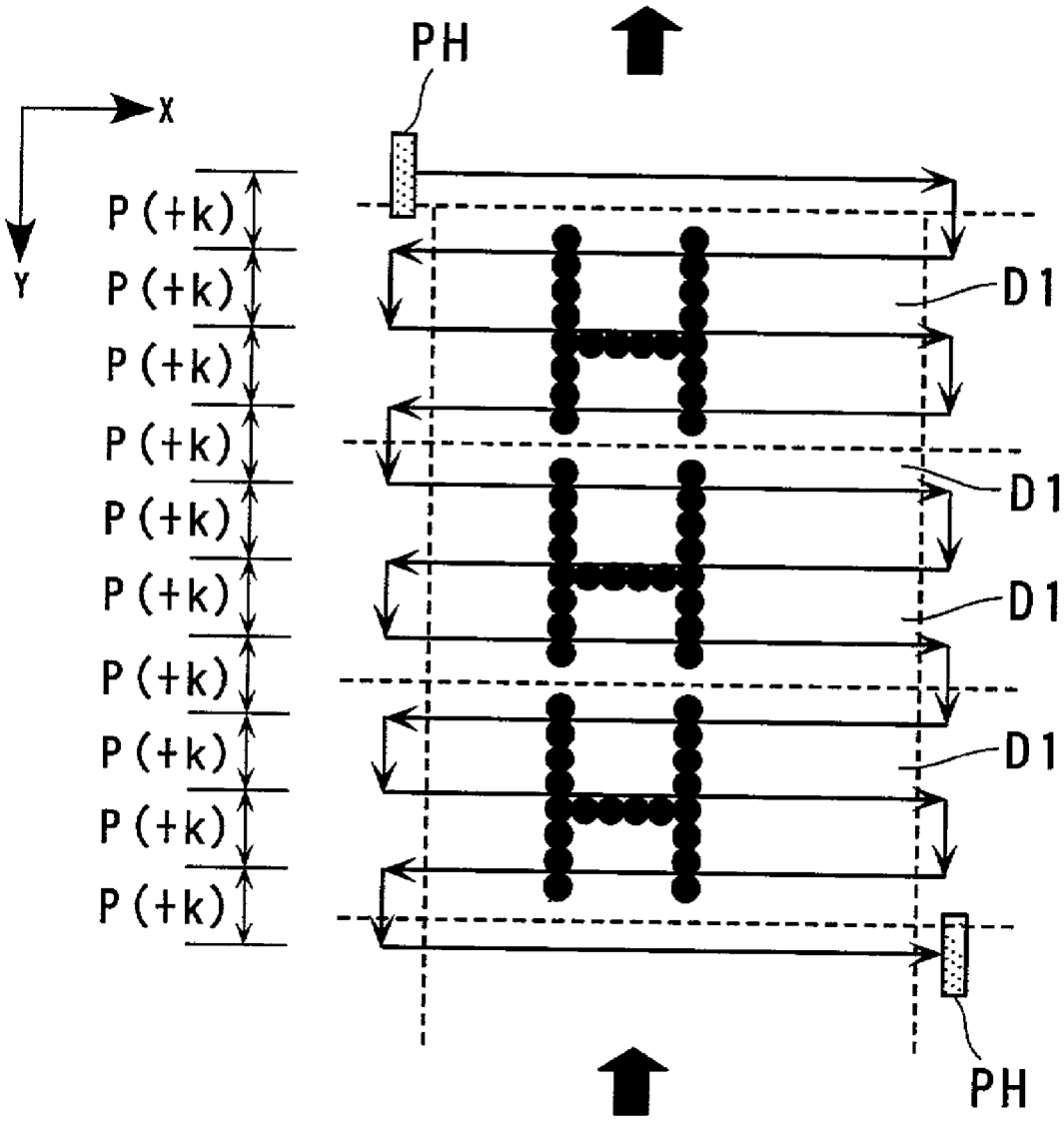
FIG. 15 is an explanatory view which is useful in explaining a process of printing the print image of the letter "H" on the print medium a plurality of times while feeding the print medium in the Y-axis direction.

For simplicity of explanation, if the unitary print image D1 is an image of the letter "H" as shown in FIG. 15, while feeding the print medium (tape T in the present embodiment) in the Y-axis direction (indicated by an up arrow in the figure), a print head PH having a plurality of nozzles arranged in the Y-axis direction is scanned in the X-axis direction and the Y-axis direction relative to the tape T, whereby the unitary print image D1 can be printed successively and in this case, no wasteful operation occurs between respective operations of printing the unitary print image D1.

Figure 16A:
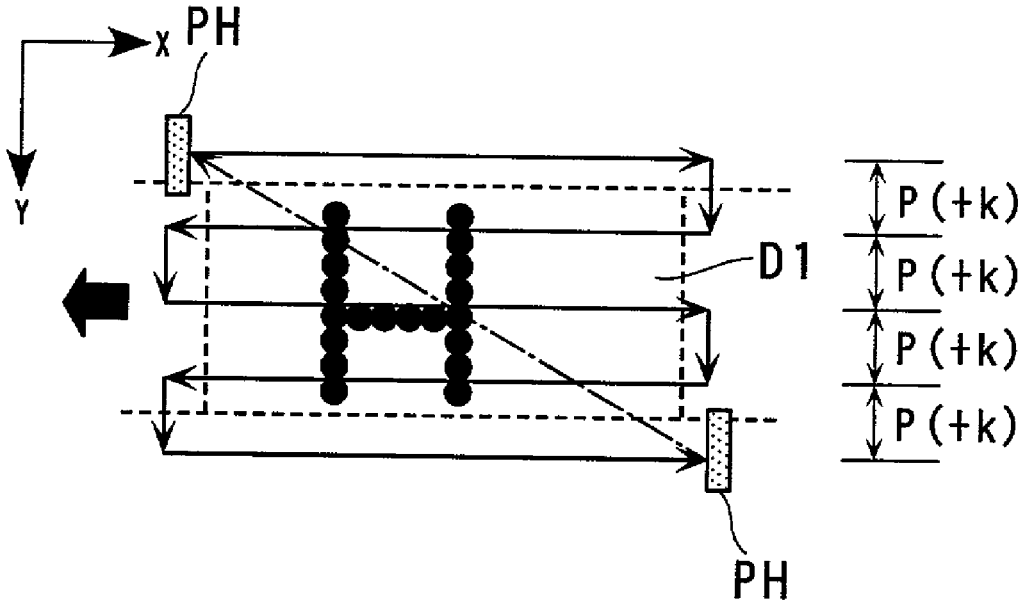
FIGS. 16A and 16B are explanatory views which are useful in explaining the returning of the print head to a home position(starting point) when the print image of the letter "H" as the unitary print image is printed a plurality of times on the print medium.
Figure 16B:
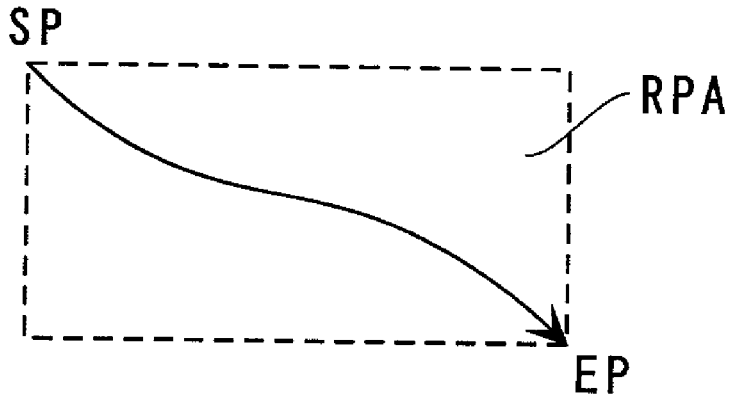

On the other hand, as shown in FIGS. 16A and 16B, when the unitary print image is printed by feeding the tape (print medium) in the X-axis direction (indicated by an left arrow in the figure), the print head PH can be located at an end position ED diagonally opposite to the home position (starting point) SP of the actual print area at the time of termination of one printing operation. In such a case, it takes much time to cause the print head to return to the home position along a path indicated by one dot chain line due to a large amount of movement, so that the return cannot be timely effected within the time of feed of the tape, and the completion thereof has to be waited for. This inevitably lowers the printing speed.

Figure 17A:
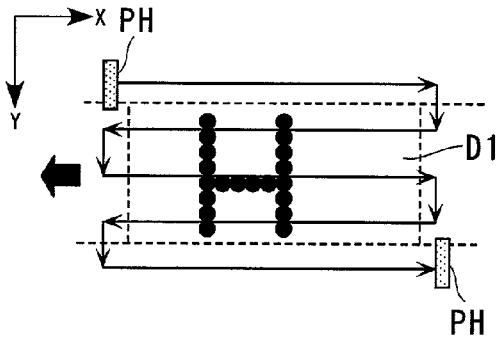
FIGS. 17A to 17D are explanatory views which are useful in explaining a printing process in which scans are carried out in opposite directions on the same scanning route in respective odd number-time and even number-time printing operations without returning the print head to the home position.
Figure 17B:
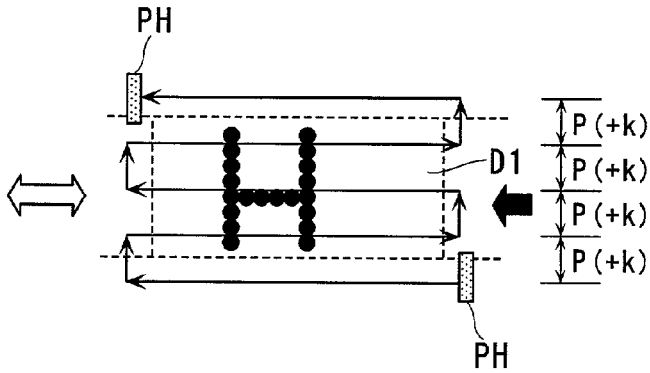
Figure 17C:
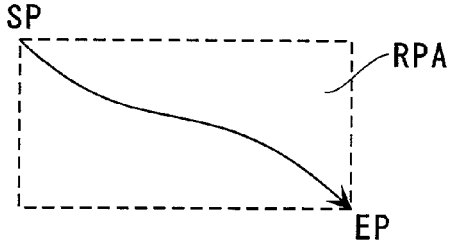
Figure 17D:
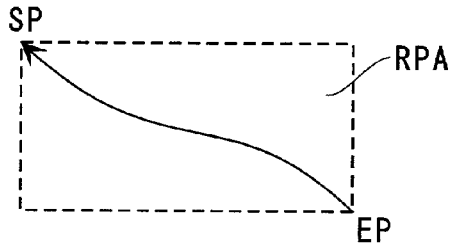

To overcome the problem, as shown in FIGS. 17A to 17D, when printing on the actual print area RPA, during an odd number-time printing operation, the print head PH is scanned in the X-axis direction and the Y-axis direction relative to the tape T such that the print head PH starts from the starting point SP and reaches the end point EP(see FIGS. 17A and 17C), whereas during an even number-time printing operation, the print head PH is scanned in the X-axis direction and the Y-axis direction relative to the tape T such that the print head PH starts from the end point EP and reaches the starting point SP (see FIGS. 17B and 17D). It should be noted that when the end point EP is not diagonally opposite to the starting point SP (e.g. an opposite corner (vertex) on the same side), the above method can be applied in the sense of reversely following the preceding printing path (scanning route).

Figure 13B:
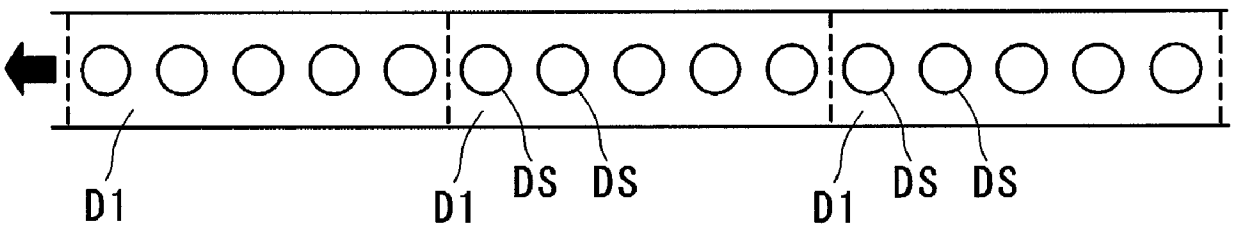
FIG. 13B is a view showing an image formed by printing the unitary print image plurality of times while feeding a tape as the print medium in the X-axis direction.

As described above, in the image printing apparatus 1, a unitary print image D1 is printed on the tape T a plurality of times (see FIG. 13) by scanning the print head PH having a plurality of (seven in the above example) nozzles in the Y-axis direction, relative to the tape T in the X-axis direction and the Y-axis direction. In this case, in the actual printing area (predetermined print area) RPA, in an odd number-time printing operation of a plurality of printing operations, printing is carried out such that the print head is scanned, starting from the starting point and reaching the end point (see FIGS. 17A and 17C), while in an even number-time printing operation of the plurality of printing operations, printing is carried out such that the print head is scanned, starting from the end point and reaching the starting point (see FIGS. 17B and 17D).

In short, printing is carried out on the same scanning path (scanning route) in opposite directions in respective odd number-time and even number-time printing operations. This makes it unnecessary to carry out the operation for returning the print head to the starting point within the time of feeding the print medium in the X-axis direction by a distance corresponding to the unitary print image. Therefore, while feeding the print medium in the X-axis direction, the print head having nozzles arranged in a line in the Y-axis direction is scanned in the X-axis direction and the Y-axis direction relative to the print medium, whereby the time wastefully used in printing operation can be minimized to increase the printing speed.

Next, referring again to FIG. 1, the image forming system (or apparatus) WS0 in the image printing system PSYS forms print image data representing a desired print image and sequentially transmits line data items of the print image data via the first interface IF1. The image printing apparatus 1 on a reception side receives each line data and prints the same on the print medium (Tape T) in the X-axis direction. Therefore, by increasing the parallelism of the communication of print image data and the printing of the print image, it is possible to increase the printing speed while receiving print image data representing a desired print image via the first interface IF1. Further, the print medium is a continuous one (tape T) and mounted in the apparatus or system such that the direction along the length of the tape coincides with the X-axis direction. This makes it possible to increase the amount of an image printable by one operation, whereby further acceleration of the print image can be attained.

Here, it is preferred that the first interface IF1 enables communication in conformity to any of the interface standards of RS-232C, USB (Universal Serial Bus), IEEE1394, Centronics, etc. Therefore, in the image printing apparatus 1, the image data I/O 26 described above with reference to FIG. 4 is compatible with the above interface standards (including interfaces conforming to any of these standards). Needless to say, the image forming system (device) WS0, which has a personal computer, an EWS, or the like, is compatible with these typical standards so that the system WS0 can perform communications in conformity to the standards via the first interface IF1.

It should be noted that the above standards are for wired communication and compatible not only with serial data communication (in the case of RS-232C, USB, IEEE1394, etc.) but also with parallel data communication (in the case of Centronics, etc). Therefore, in the image printing system PSYS, whichever of the above interface standards may be employed for communication, it is possible to communicate print image data representing a desired print image DS in units of line data items via the first interface IF1, and at the same time print a plurality of (N) copies of the print image DS at a high speed. It goes without saying that the first interface IF1 can be one enabling wireless communication.

Further, as shown in FIG. 1, in the image printing system PSYS, the image forming system WS0 may be configured such that it is comprised of a work station WS2 having a personal computer, EWS or the like for use in designing print images, and a work station WS1 including a personal computer or the like for outputting print line data. In this case, the work station WS2 forms print image data representing a desired print image, and transmits the print image data via the second interface IF2. On the other hand, the work station WS1 divides the received print image data into line data items to sequentially send the line data items one by one via the first interface IF1. The image printing apparatus 1 prints on the tape (print medium) T in the X-axis direction. Therefore, in this case as well, the image printing system PSYS is capable of performing the communication of print image data and printing of a plurality of print images formed based on the print image data with enhanced parallelism, thereby making it possible to increase the overall printing speed, and increasing the amount of data printable per one scan to further increase the printing speed.

In this embodiment, it is preferred that the second interface IF2 enables communication via a predetermined network. For instance, when the predetermined network includes the Internet and a predetermined local area network (LAN), the second interface IF2 enables communication via the predetermined network including the Internet and the predetermined LAN. Further, it is preferred that the second interface IF2 enables communication in conformity to an IEEE standard LAN-based communication protocol and at least one of the data link protocols of an Ethernet, an FDDI (Fiber Distributed Data Interface), and an ATM (Automated Teller Machine). It should be noted that in addition to the above data link protocols, those of Token Ring, 100VG-AnyLAN, Fiber Channel, HIPPI (High Performance Parallel Interface), IEEE1394 (Fire Wire), and so forth can be used. Further, it goes without saying that the second interface IF2 can employ wireless communication according to at least one of the protocols.

Although in the above embodiment, the description has been give based on an example of the multi-head structure which is simplified for clarity of explanation, it goes without saying that a single head structure can be also employed.

It is further understood by those skilled in the art that the foregoing is a preferred embodiment of the invention, and that various changes and modifications may be made without departing from the spirit and scope thereof.

What is claimed is:

1. An ink jet printer including a print head having M nozzles, where M is an integer equal to or larger than 2, the print head capable of simultaneously printing M dots at a predetermined nozzle pitch in a direction along a Y axis, assuming that two axes orthogonal to each other on a two-dimensional rectangular coordinate system are set to an X axis and the Y axis, respectively, the ink jet printer printing a print image on a print medium while feeding the print medium in a direction along the X axis, by causing relative scan of the print head in the direction along the X axis and in the direction along the Y axis, relative to the print medium, the ink jet printer comprising:

print image width-determining means for determining a print image width defined as a width of the print image in the direction along the Y axis;

head moving pitch-setting means for setting a head moving pitch in the relative scan in the direction along the Y axis, based on the print image width;

X-axis relative scan means for causing the relative scan of the print head in the direction along the X axis relative to the print medium, thereby causing printing of maximum M dot lines extending in the direction along the X axis arranged side by side in the Y-axis direction; and Y-axis relative scan means for causing the relative scan of the print head in the direction along the Y axis, by moving the print head relative to the print medium at the head moving pitch, after printing by the relative scan of the print head in the direction along the X axis.

2. An ink jet printer according to claim 1, wherein said head moving pitch-setting means includes head moving pitch-determining means for determining the head moving pitch in the direction along the Y axis according to the print image width.

3. An ink jet printer according to claim 2, wherein said head moving pitch-determining means determines the head moving pitch by looking up tables of printing dot numbers corresponding to respective combinations of each of consecutive integers representative of respective ones of the M nozzles and each of integers representative of respective positions in order of printing passes in a sequence of the printing passes, the tables being prepared for respective values of the head moving pitch.

4. An ink jet printer according to claim 1, wherein said head moving pitch-setting means includes print width-comparing means for comparing a unitary printable width determined based on a nozzle array length corresponding to a distance between ones of the M nozzles of the print head at respective opposite ends of an array of the nozzles, and the print image width.

5. An ink jet printer according to claim 1, wherein said head moving pitch-setting means includes print resolution-dependent adjusting means for adjusting the head moving pitch based on relationship between the nozzle pitch of the print head and a resolution of the print image.

6. An ink jet printer according to claim 1, further including print image storage means for storing print image data representing said print image.

7. An ink jet printer according to claim 1, further including print medium width-detecting means for detecting a width of the print medium in the direction along the Y axis as a print medium width.

8. An ink jet printer according to claim 1, wherein the print medium is a continuous one, and is mounted in the ink jet printer such that a direction along a length thereof coincides with the direction along the X axis.

9. A printing method for an ink jet printer including a print head having M nozzles, where M is an integer equal to or larger than 2, the print head capable of simultaneously printing M dots at a predetermined nozzle pitch in a direction along a Y axis, assuming that two axes orthogonal to each other on a two-dimensional rectangular coordinate system are set to an X axis and the Y axis, respectively, the ink jet printer printing a print image on a print medium while feeding the print medium in a direction along the X axis, by causing relative scan of the print head in the direction along the X axis and in the direction along the Y axis, relative to the print medium, the printing method comprising the steps of:

determining a print image width defined as a width of the print image in the direction along the Y axis;

setting a head moving pitch in the relative scan in the direction along the Y axis, based on the print image width;

causing the relative scan of the print head in the direction along the X axis relative to the print medium, thereby printing maximum M dot lines extending in the direction along the X axis arranged side by side in the Y-axis direction; and causing the relative scan of the print head in the direction along the Y axis, by moving the print head relative to the print medium at the head moving pitch, after printing by the relative scan of the print head in the direction along the X axis.

10. A printing method according to claim 9, wherein the step of setting a head moving pitch includes determining the head moving pitch according to the print image width.

11. A printing method according to claim 10, wherein the head moving pitch is determined by looking up tables of printing dot numbers corresponding to respective combinations of each of consecutive integers representative of respective ones of the M nozzles and each of integers representative of respective positions in order of printing passes in a sequence of the printing passes, the tables being prepared for respective values of the head moving pitch.

12. A printing method according to claim 9, wherein the step of setting a head moving pitch includes comparing a unitary printable width determined based on a nozzle array length corresponding to a distance between ones of the M nozzles of the print head at respective opposite ends of an array of the nozzles, and the print image width.

13. A printing method according to claim 9, wherein the step of setting a head moving pitch includes adjusting the head moving pitch based on relationship between the nozzle pitch of the print head and a resolution of the print image.

14. A printing method according to claim 9, further including the step of storing print image data representing said print image.

15. A printing method according to claim 9, further including the step of detecting a width of the print medium in the direction along the Y axis as a print medium width.

16. A printing method according to claim 9, wherein the print medium is a continuous one, and is mounted in the ink jet printer such that a direction along a length thereof coincides with the direction along the X axis.

* * * * *